US012723411B2

(12) United States Patent
Shimazaki

(10) Patent No.: US 12,723,411 B2
(45) Date of Patent: Sep. 1, 2026

(54) MOUNTING METHOD OF BUILDING SURFACE MATERIAL

(71) Applicant: YOSHINO GYPSUM CO., LTD., Tokyo (JP)

(72) Inventor: Junetsu Shimazaki, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 171 days.

(21) Appl. No.: 18/681,965

(22) PCT Filed: Oct. 20, 2022

(86) PCT No.: PCT/JP2022/039127
§ 371 (c)(1),
(2) Date: Feb. 7, 2024

(87) PCT Pub. No.: WO2023/112478
PCT Pub. Date: Jun. 22, 2023

(65) Prior Publication Data

US 2025/0116117 A1 Apr. 10, 2025

(30) Foreign Application Priority Data

Dec. 17, 2021 (JP) ..... 2021-205428

(51) Int. Cl.
*E04F 13/08* (2006.01)

(52) U.S. Cl.
CPC ..... *E04F 13/0885* (2013.01); *E04F 13/0883* (2013.01)

(58) Field of Classification Search
CPC ..... E04F 13/08; E04F 13/088; E04F 13/0883; E04F 13/0885; E04F 13/0887;
(Continued)

(56) References Cited

U.S. PATENT DOCUMENTS 2,366,674 A * 1/1945 Petty ..... E04F 21/026 156/71
3,986,312 A * 10/1976 Calhoun ..... E04B 2/7863 52/DIG. 4
(Continued)

FOREIGN PATENT DOCUMENTS

CA 3080666 A1 * 11/2020 ..... E04G 21/1858
CN 111827638 A * 10/2020 ..... E04F 21/18
(Continued)

OTHER PUBLICATIONS

Machine Translation of JP2019-190046A (Year: 2019).*
(Continued)

*Primary Examiner* — Ryan D Kwiecinski
(74) *Attorney, Agent, or Firm* — IPUSA, PLLC

(57) ABSTRACT

There is provided a mounting method for a building surface material that has good mounting properties and that ensures a predetermined adhesive area, in which a base material and a building surface material can be mounted via an adhesive. A mounting method of a building surface material for mounting the building surface material to a base material made of steel, the mounting method including a temporary fixing step of temporarily fixing a part of a back surface of the building surface material to an adhesive adhered to a mounting surface of the base material; and a main fixing step of bringing a magnetic attraction jig in contact with a front surface on an opposite side of the back surface of the building surface material, and moving the magnetic attraction jig along the adhesive to attract the base material by an attraction force of the magnetic attraction jig and pressure-bond the building surface material and the base material to each other.

8 Claims, 18 Drawing Sheets

(58) Field of Classification Search
CPC ... E04F 21/1657; E04F 21/18; E04F 21/1866; E04F 21/1838; E04B 2/7457; E04B 2002/7461; E04B 2002/7472
See application file for complete search history.

(56) References Cited

U.S. PATENT DOCUMENTS

| | | | | | |
|---|---|---|---|---|---|
| 4,041,667 | A * | 8/1977 | Lindner | E04B 2/7457 | 52/309.1 |
| 4,069,639 | A * | 1/1978 | Lindner | E04B 2/7457 | 52/745.1 |
| 4,202,288 | A * | 5/1980 | Davy, Jr. | E04F 21/1657 | 118/123 |
| 4,217,673 | A * | 8/1980 | Pearson | E04F 21/165 | 15/235.7 |
| 5,254,203 | A * | 10/1993 | Corston | E04B 2/7412 | 156/577 |
| 5,403,414 | A * | 4/1995 | Corston | E04B 5/12 | 52/480 |
| 2002/0002805 | A1* | 1/2002 | Yamaguchi | E04B 2/7457 | 52/459 |
| 2008/0209658 | A1* | 9/2008 | Rosso | E04F 21/163 | 15/245.1 |
| 2009/0320407 | A1* | 12/2009 | Johansson | E04B 2/7457 | 52/746.1 |
| 2015/0292213 | A1* | 10/2015 | Oliver | E04F 13/081 | 52/506.05 |
| 2019/0112819 | A1* | 4/2019 | Gebhardt | E04F 13/0839 | |
| 2020/0386005 | A1* | 12/2020 | Bélanger | E04G 21/1858 | |
| 2021/0140179 | A1* | 5/2021 | House | E04F 21/0053 | |
| 2021/0148115 | A1* | 5/2021 | Haller | E04B 2/7457 | |
| 2021/0388625 | A1* | 12/2021 | Baker | E04F 13/0885 | |
| 2023/0265665 | A1* | 8/2023 | Gill | B05B 9/0866 | 118/300 |
| 2023/0340791 | A1* | 10/2023 | Freidberg | E04F 21/1657 | |
| 2025/0116117 | A1* | 4/2025 | Shimazaki | E04F 13/08 | |

FOREIGN PATENT DOCUMENTS

| | | | | | |
|---|---|---|---|---|---|
| DE | 202012102265 | U1 * | 7/2012 | E04B 2/7457 | |
| DE | 102013109897 | A1 * | 3/2015 | E04C 2/521 | |
| FR | 3143052 | A1 * | 6/2024 | E04F 21/026 | |
| GB | 2426527 | A * | 11/2006 | E04F 13/0835 | |
| JP | S51-039360 | Y | 9/1976 | | |
| JP | S61-155547 | U | 9/1986 | | |
| JP | 2003-147940 | | 5/2003 | | |
| JP | 2003147940 | A * | 5/2003 | | |
| JP | 2019-190046 | | 10/2019 | | |
| JP | 2019190046 | A * | 10/2019 | | |
| JP | 2020-139404 | | 9/2020 | | |
| WO | WO-2008026982 | A1 * | 3/2008 | E04F 21/1866 | |
| WO | WO-2016108742 | A1 * | 7/2016 | E04B 2/7457 | |
| WO | WO-2017197503 | A1 * | 11/2017 | E04F 13/0883 | |
| WO | WO-2023112478 | A1 * | 6/2023 | E04F 13/0883 | |

OTHER PUBLICATIONS

Machine Translation of JP2003-147940 (Year: 2003).*
Machine Translation of JP2020139404 (Year: 2020).*
International Search Report for PCT/JP2022/039127 mailed on Dec. 20, 2022.
Written Opinion of the International Searching Authority for PCT/JP2022/039127 mailed on Dec. 20, 2022.

* cited by examiner

MOUNTING METHOD OF BUILDING SURFACE MATERIAL

TECHNICAL FIELD

The present disclosure relates to a mounting method of a building surface material.

BACKGROUND OF THE INVENTION

A wall such as a partition wall or a boundary wall of a building is formed by mounting a building surface material to a plurality of studs (intermediate posts) that are laterally installed at intervals, with upper and lower ends supported by upper and lower runners mounted to the floor or the ceiling. The method of mounting a building surface material to studs is generally carried out by using fasteners such as screws, nails, clinchers, etc.; however, the mounting method using fasteners requires time for the mounting, and noise during the mounting and the creation of fastener marks on the surface of the building surface material cannot be prevented, and, therefore, there are problems in that the workability is not good.

Accordingly, patent document 1 proposes a building surface structure which enables the building surface material (here, the structure surface material) to be mounted to a crosspiece with good workability. The building surface structure is arranged between the structure surface material and the crosspiece and has a viscoelastic body for fixing the structure surface material to the crosspiece. In view of the fact that the viscoelastic body is a double-sided adhesive tape and it is often difficult to adhere the structure surface material to the double-sided adhesive tape with high adhesive force only by pressing the structure surface material against the double-sided adhesive tape, pressure is further applied from the front surface side of the structure surface material toward the double-sided adhesive tape to adhere the structure surface material to the double-sided adhesive tape with high adhesive force. Here, as a method of applying pressure, a long and thin plate is pressed to the position where the double-sided adhesive tape of the structure surface material exists so that the plate is along the longitudinal direction, the plate is struck by a striking means, and a large force is applied to the roller or the bottom of the palm to tighten pressure.

RELATED ART DOCUMENTS

Patent Document

Patent document 1: Japanese Unexamined Patent Application Publication No. 2019-190046

SUMMARY OF THE INVENTION

Problems to be Solved by the Invention

According to the building surface structure described in Patent Document 1, the workability is improved by mounting the structure surface material to the crosspiece by using a viscoelastic body (a double-sided adhesive tape), instead of the method of mounting the structure surface material to the crosspiece by using a fastener.

However, in the method of applying pressure by pressing the plate against the position where the double-sided adhesive tape of the structure surface material exists, excessive pressing pressure is required because the pressing pressure may be distributed when, for example, the base material to which the structure surface material is mounted is slightly bent.

Further, although it is necessary to secure a predetermined adhesive area when the structure surface material is mounted to the crosspiece, because it is difficult to confirm the position of the double-sided adhesive tape as the double-sided adhesive tape on the back of the structure surface material is hidden by the structure surface material, it is difficult to sufficiently press the double-sided adhesive tape, thereby making it difficult to secure a predetermined adhesive area.

An object of the present disclosure is to provide a method of mounting a building surface material, with good mounting properties, enabling a base material and a building surface material to be mounted via an adhesive having a predetermined adhesive area.

Means for Solving the Problem

A mounting method of a building surface material according to an aspect of the present disclosure is a mounting method of a building surface material for mounting the building surface material to a base material made of steel, the mounting method including

- a temporary fixing step of temporarily fixing a part of a back surface of the building surface material to an adhesive adhered to a mounting surface of the base material; and
- a main fixing step of bringing a magnetic attraction jig in contact with a front surface on an opposite side of the back surface of the building surface material, and moving the magnetic attraction jig along the adhesive to attract the base material by an attraction force of the magnetic attraction jig and pressure-bond the building surface material and the base material to each other.

Further, a mounting method of a building surface material according to another aspect of the present disclosure is a mounting method of a building surface material for mounting an underlining surface material and an overlining surface material which are the building surface material to a base material made of steel, the mounting method including

- a first main fixing step of fixing the underlining surface material to a mounting surface of the base material with a fastener;
- a temporary fixing step of temporarily fixing a part of a back surface the overlining surface material to an adhesive adhered to a front surface of the underlining surface material on an opposite side of a back surface of the underlining surface material facing the mounting surface; and
- a second main fixing step of bringing a magnetic attraction jig in contact with a front surface of the overlining surface material on an opposite side of the back surface of the overlining surface material, and moving the magnetic attraction jig along the adhesive to attract the base material by an attraction force of the magnetic attraction jig and pressure-bond the overlining surface material and the base material to each other.

Further, a mounting method of a building surface material according to another aspect of the present disclosure is a mounting method of a building surface material for mounting an underlining surface material and an overlining surface material which are the building surface material to a base material made of steel, the mounting method comprising:

a first temporary fixing step of temporarily fixing a part of a back surface of the underlining surface material to an adhesive adhered to a mounting surface of the base material;

a first main fixing step of bringing a magnetic attraction jig in contact with a front surface of the underlining surface material on an opposite side of the back surface of the underlining surface material, and moving the magnetic attraction jig along the adhesive to attract the base material by an attraction force of the magnetic attraction jig and pressure-bond the underlining surface material and the base material to each other;

a second temporary fixing step of temporarily fixing a part of a back surface of the overlining surface material to an adhesive adhered to the front surface of the underlining surface material; and a second main fixing step of bringing the magnetic attraction jig in contact with a front surface of the overlining surface material on an opposite side of the back surface of the overlining surface material, and moving the magnetic attraction jig along the adhesive to attract the base material by an attraction force of the magnetic attraction jig and pressure-bond the overlining surface material and the base material to each other.

Effects of the Invention

According to the present disclosure, the base material and the building surface material can be mounted via an adhesive which has good mounting properties and a predetermined adhesive area.

DETAILED DESCRIPTION OF THE INVENTION

Figure 1:
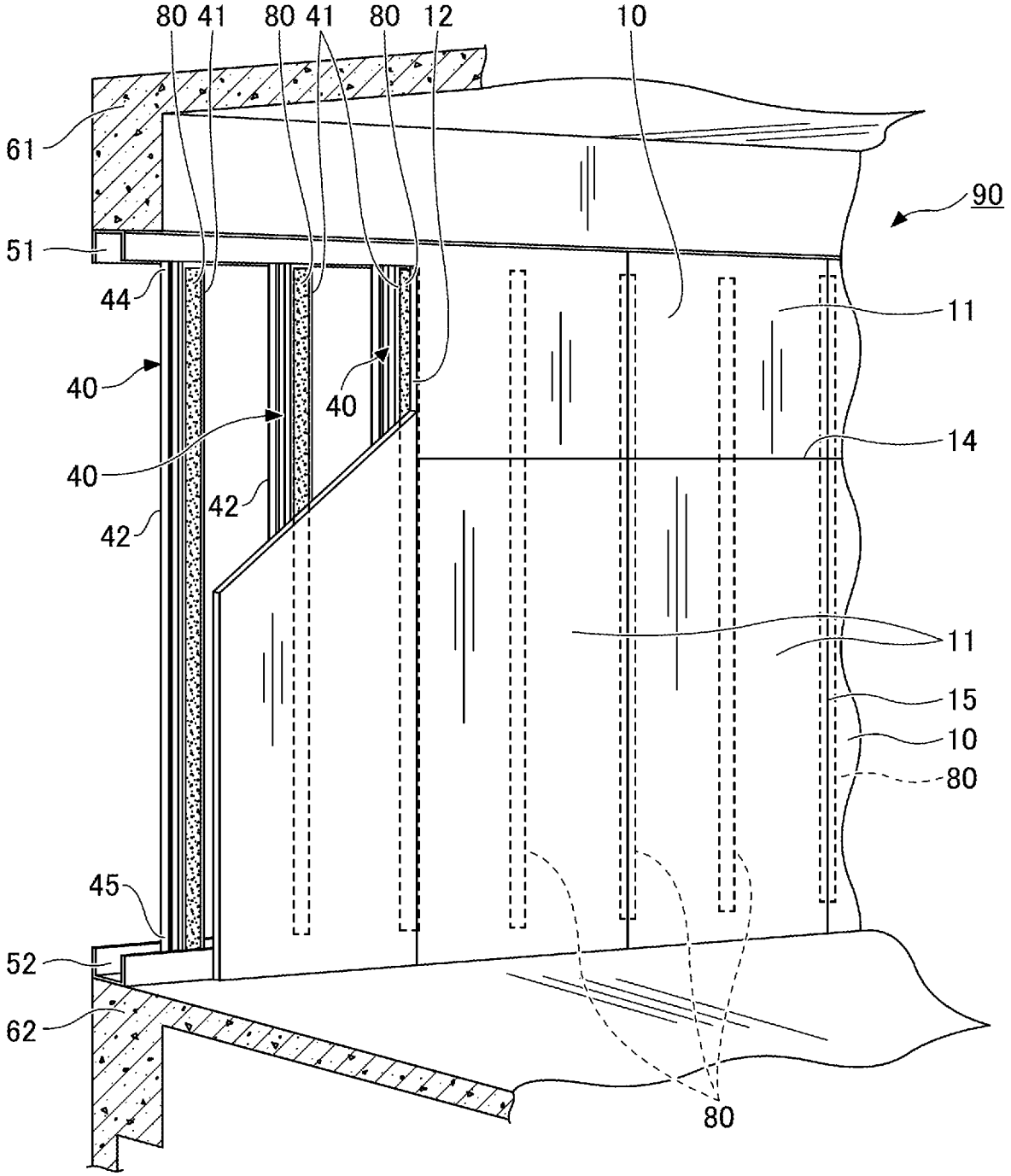
FIG. 1 is a perspective view illustrating an example of a partition wall formed by the mounting method of the building surface material according to a first embodiment, in which a part of the building surface material is illustrated to appear fractured.

Hereinafter, an example of the method of mounting a building surface material according to each embodiment will be described with reference to the attached drawings. In the present specification and the drawings, substantially the same elements may be denoted by the same reference numerals to omit duplicate descriptions.

[Mounting Method of a Building Surface Material According to a First Embodiment]

Figure 2:
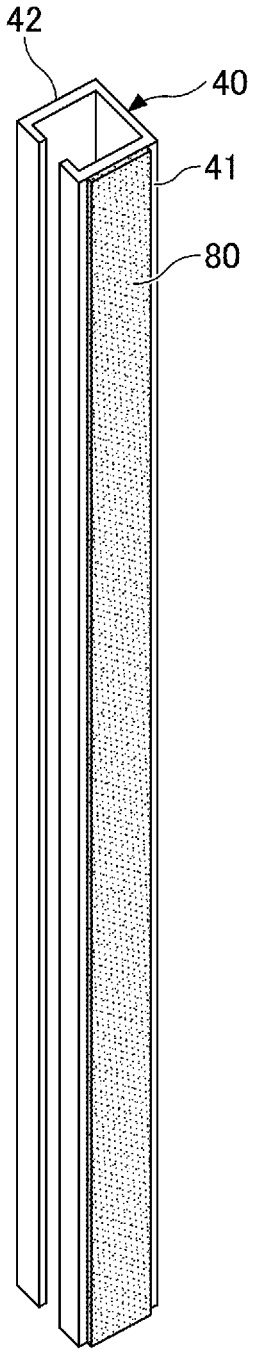
FIG. 2 is a process diagram explaining the mounting method of the building surface material according to the first embodiment.
Figure 3:
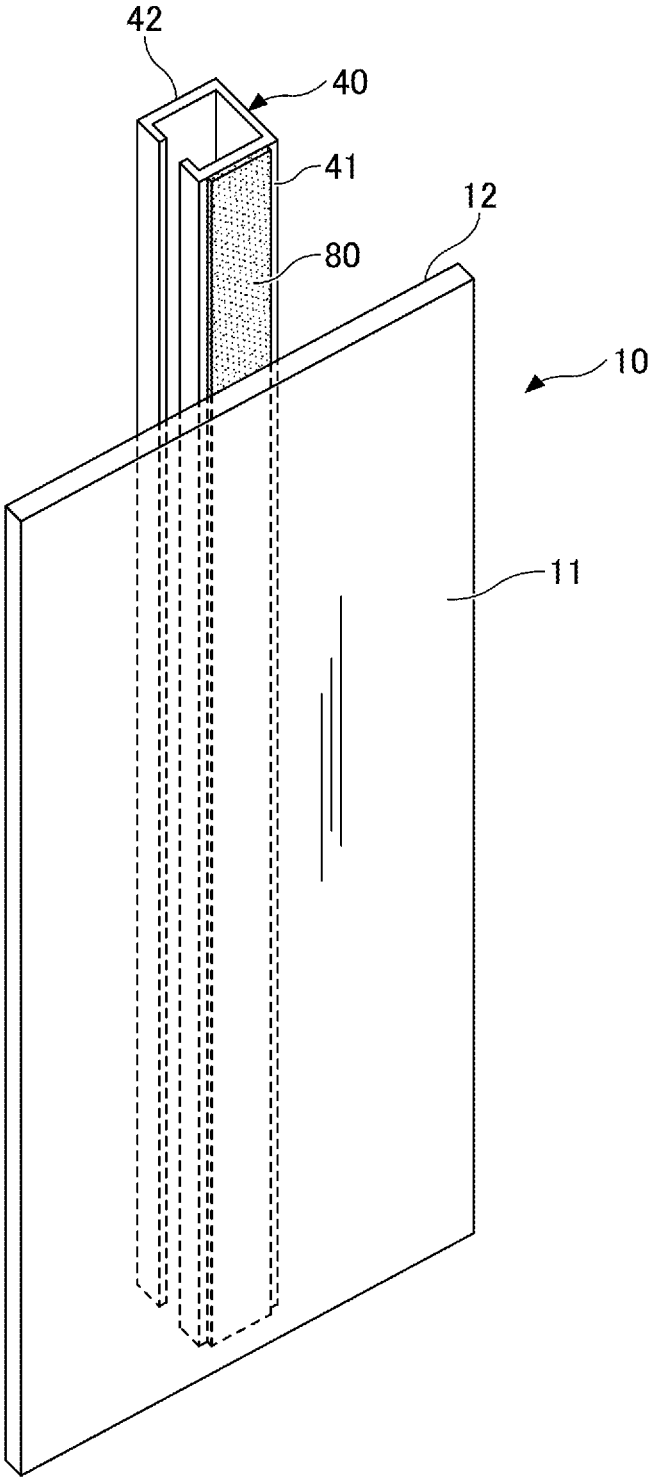
FIG. 3 is a process diagram explaining the mounting method of the building surface material according to the first embodiment following FIG. 2.
Figure 4:
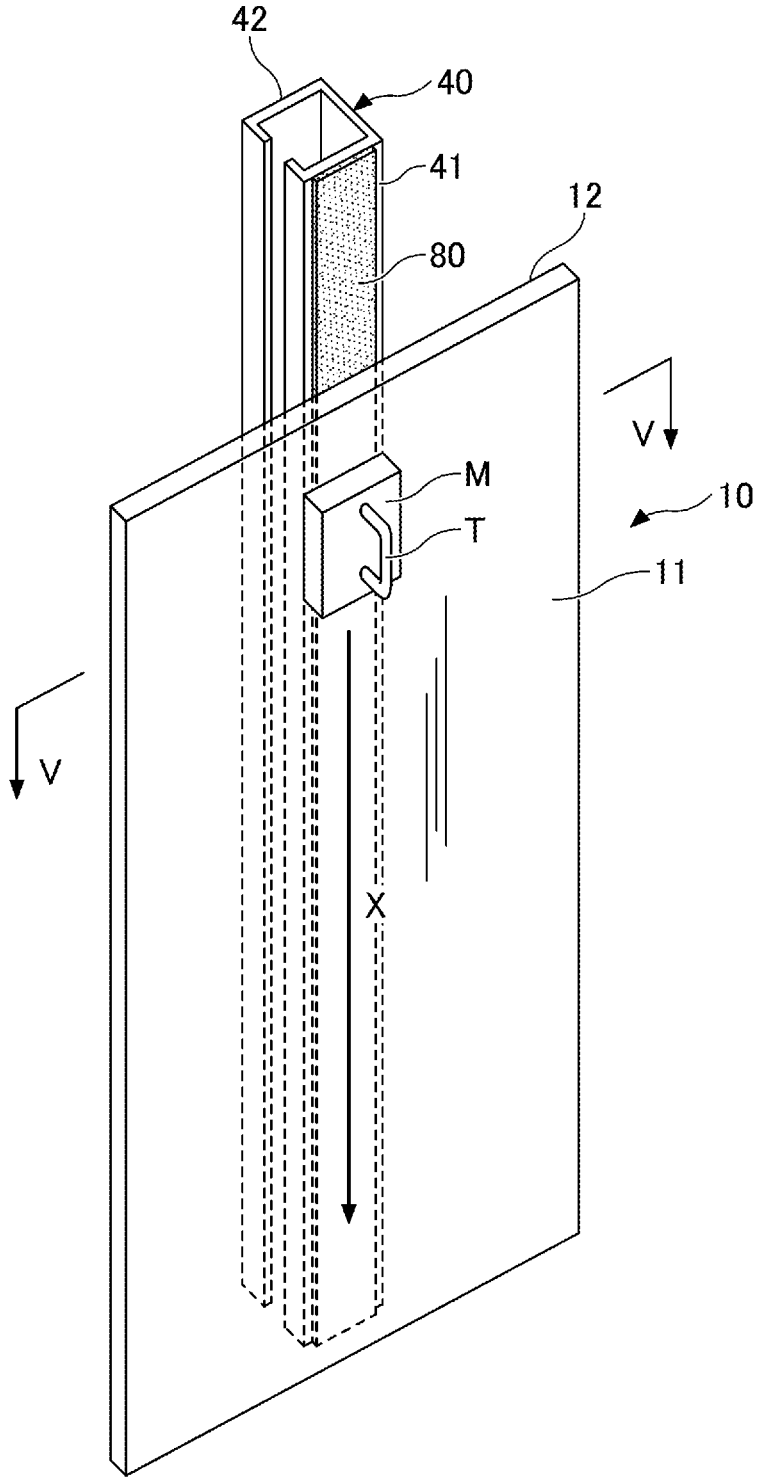
FIG. 4 is a process diagram explaining the mounting method of the building surface material according to the first embodiment following FIG. 3.
Figure 5:
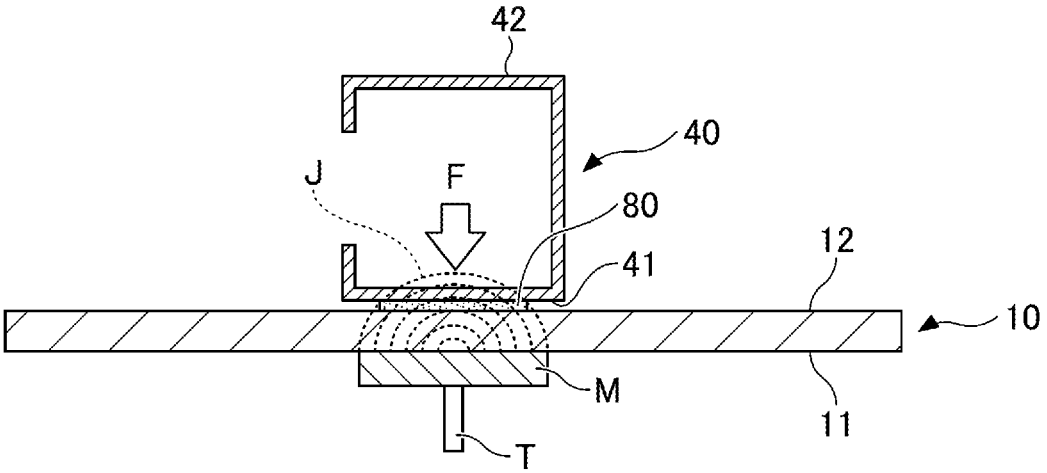
FIG. 5 is a V-V arrow view of FIG. 4 explaining a state in which a magnetic field is generated by a magnetic attraction jig and a stud is magnetically attracted.

First, an example of a method of mounting a building surface material according to the first embodiment and an example of a partition wall formed by the mounting method will be described with reference to FIGS. 1 to 5. FIG. 1 is a perspective view illustrating an example of a partition wall formed by the method of mounting a building surface material according to the first embodiment, in which a part of the building surface material is illustrated to appear fractured. FIGS. 2 to 4 are process diagrams for sequentially explaining the method of mounting a building surface material according to the first embodiment, and FIG. 5 is a view along the V-V arrow in FIG. 4, in which a magnetic field is generated by a magnetic attraction jig, and the stud is magnetically attracted.

Hereinafter, the mounting method of the building surface material according to each embodiment will be described as a method of forming a partition wall, but the mounting method of the building surface material according to each embodiment can also be applied to the formation of a boundary wall and the like other than a partition wall, and can also be applied to the formation of a ceiling and a floor other than walls such as a partition wall and a boundary wall.

A partition wall 90 illustrated in FIG. 1 is applied to a steel-framed building, a reinforced concrete (RC) building, a wooden building, etc., and these buildings include a factory, a warehouse, etc., in addition to general detached houses and condominiums.

The partition wall 90 has a plurality of studs 40 (an example of a base material) constituting main shafts, and a lower runner 52 (or a floor runner) and an upper runner 51 (or a ceiling runner). The studs 40 extend in the longitudinal direction (vertical direction), and the upper runner 51 and the lower runner 52 extend in the lateral direction (horizontal direction).

Both the upper runner 51 and the lower runner 52 are formed of a lightweight steel frame member such as grooved steel, and the upper runner 51 is mounted to an upper floor structure 61 with the opening facing downward, and the lower runner 52 is mounted to a lower floor structure 62 with the opening facing upward.

The studs 40 are formed of grooved steel with lips of lightweight steel frames, but may be formed of grooved steel or a square steel pipe.

An upper end 44 and a lower end 45 of each stud 40 are fixed to the upper runner 51 and the lower runner 52 by being fit to the upper runner 51 and the lower runner 52, respectively. Here, although not illustrated, a plurality of oscillation stoppers extending in the horizontal direction may be provided at a predetermined pitch (e.g., 1200 mm pitch) in the height direction of the stud 40.

The upper runner 51, the lower runner 52, and the stud 40 are, for example, lightweight steel frame members having a thickness of 0.4 mm or more, and steel runners and steel studs specified in JIS (Japanese Industrial Standards) A 6517 ("building steel base material"), or equivalent, compliant, or compatible materials may be applied. In the partition wall 90, a plurality of studs 40 are built between the lower runner 52 and the upper runner 51 at intervals of 606 mm or less (for example, intervals of 606 mm and 455 mm) in the width direction of the wall (longitudinal direction of the lower runner 52 and the like in FIG. 1).

In the partition wall 90, the building surface material 10 arranged longitudinally is mounted to a pair of mounting surfaces 41 and 42 of the studs 40. FIG. 1 illustrates a state in which the building surface material 10 is mounted only to one mounting surface 41 at the front as viewed in the figure. The building surface material 10 may be laterally arranged and mounted to the stud 40.

The building surface material 10 is formed of a gypsum plate or a gypsum board, a calcium silicate plate, a particle board, a hardboard, plywood, structural plywood, or the like. For example, when a gypsum board is applied, the short side, the long side, and the thickness thereof are formed of a 910 mm×1820 mm×9.5 mm quasi-noncombustible material or a 910 mm×1820 mm (2420 mm or 2730 mm)×12.5 mm (15 mm, 21 mm, or 25 mm) noncombustible material, etc. The width of the gypsum board may be other than 910 mm, such as 606 mm, 1000 mm, 1220 mm, etc. In addition to a general gypsum board, a gypsum board includes a reinforced gypsum board, an ordinary hard gypsum board, a gypsum plate with a glass fiber nonwoven fabric, a glass mat gypsum board, etc.

A plurality of the building surface materials 10 that are adjacent to each other at the top, bottom, left, and right are mutually butted to form a lateral butt joint 14 and a longitudinal butt joint 15. In the illustrated example, each building surface material 10 is arranged so that the longitudinal butt joint 15 is formed at a central position of the mounting surface 41 of the stud 40 at every other stud. The lateral butt joint 14 and the longitudinal butt joint 15 may be a transparent joint.

An adhesive 80 is adhered to the mounting surface 41 of each stud 40 along the longitudinal direction, and the building surface material 10 is mounted to the mounting surface 41 via the adhesive 80. Note that a building surface material (not illustrated) is mounted to the other mounting surface 42 by the same method.

As the adhesive 80, an acrylic adhesive, a rubber-based adhesive, a urethane-based adhesive, a silicone-based adhesive, or the like may be applied, and these may be applied alone or two or more types may be applied in combination. In particular, the acrylic adhesive is suitable because of the advantages in being excellent in transparency, weather resistance, and heat resistance, enabling various polymers to be designed because of the large number of monomers, enabling the molecular weight and the molecular distribution to be controlled to some extent, and enabling crosslinking to be adjusted by copolymerizing functional group monomers.

Here, the adhesive 80 in the illustrated example is a single adhesive layer, but the adhesive 80 may also be an adhesive tape or the like in which adhesive layers are provided on both sides of a central support (not illustrated).

When mounting the building surface material to the studs, by applying the adhesive 80 instead of fixing the building surface material with conventional fasteners such as typical screws, the partition wall 90 can shorten the time required for mounting the building surface material and obtain good workability. Furthermore, by interposing the adhesive 80 between the studs 40 and the building surface material 10, the viscoelasticity of the adhesive 80 can attenuate the deformation (vibration) of the building surface material 10 in the in-plane direction and the out-of-plane direction caused by traffic vibration, earthquake vibration, etc., thereby preventing damage to the building surface material 10, cross breakage, etc.

Next, with reference to FIGS. 2 to 5, a method for mounting the building surface material 10 forming the partition wall 90 illustrated in FIG. 1, to the mounting surface 41 of the stud 40, will be described. In the following, a single stud 40 will be taken as an example to describe the method for mounting the building surface material 10 to the mounting surface 41 of the single stud 40. However, in the example illustrated in FIG. 1, the building surface material 10 is mounted to the mounting surfaces 41 of the three studs 40 arranged side by side along the lateral direction, by the same method.

First, as illustrated in FIG. 2, the adhesive 80 is adhered to the mounting surface 41 of the stud 40 along the longitudinal direction.

For example, the adhesive 80 may be in a form of being wound up or may be in a form of a strip, with a peeling sheet (not illustrated) being adhered to the wide surface on one side. A worker adheres one end of the wound up adhesive 80 to the upper or lower end of the mounting surface 41, and then successively adheres the adhesive 80 toward the other end of the mounting surface 41 while expanding the adhesive.

When the adhesive 80 is adhered to the mounting surface 41, a peeling sheet (not illustrated) is adhered to the surface of the adhesive 80 (the front side as viewed in FIG. 2). When a worker removes the peeling sheet (not illustrated) adhered to the surface of the adhesive 80, the surface of the adhesive 80 adhered to the stud 40 as illustrated in FIG. 2 is exposed so that the building surface material can be adhered. When the peeling sheet is peeled off, a roller (not illustrated) is moved along the surface of the peeling sheet while being pressed, thereby improving the peelability of the peeling sheet from the adhesive 80.

Next, as illustrated in FIG. 3, the building surface material 10 is positioned with respect to the mounting surface 41 of the stud 40, a part of a back surface 12 of the building surface material 10 is adhered to the adhesive 80, and the building surface material 10 is adhered by being pressed from the front surface 11 to the back surface side.

If the building surface material 10 is simply pressed to the stud 40 via the adhesive 80, it may be difficult to mount the building surface material 10 to the stud 40 with a high adhesive force.

For example, if the stud 40 is slightly deflected, the pressing pressure when pressing the front surface 11 of the building surface material 10 will be distributed, and, therefore, excessive pressing pressure will be required.

Further, although it is necessary to secure a predetermined adhesive area when a part of the back surface 12 of the building surface material 10 is mounted to the mounting surface 41 of the stud 40, the adhesive 80 is concealed by the building surface material 10 at the time of mounting, and, therefore, it is difficult to sufficiently press the adhesive 80 due to the difficulty in locating the adhesive 80, and consequently, securing the predetermined adhesive area becomes difficult.

Therefore, in the mounting process illustrated in FIG. 3, the building surface material 10 is positioned by being temporarily fixed to the mounting surface 41 of the stud 40, and the temporary fixing step is performed before the main fixing step (temporary fixing step).

After the building surface material 10 is temporarily fixed to the mounting surface 41 of the stud 40, as illustrated in FIG. 4, a magnetic attraction jig M gripped by a worker (not illustrated) is brought into contact with the front surface 11 of the building surface material 10 and is moved in the X direction along the adhesive 80.

A handle T is mounted to the magnetic attraction jig M, and the worker moves the magnetic attraction jig M by gripping the handle T. Although the illustrated example is described as a method of moving the magnetic attraction jig M vertically downward from the upper end to the lower end of the building surface material 10, the magnetic attraction jig M may be moved from the lower end to the upper end of the building surface material 10, or the magnetic attraction jig M may be moved from the middle stage to the upper end of the building surface material 10, and then moved from the middle stage to the lower end.

The magnetic attraction jig M is a permanent magnet, and an alnico magnet, a ferrite magnet, a neodymium magnet, or the like may be applied. Here, a temporary magnet such as an electromagnet or the like may be applied instead of a permanent magnet.

As illustrated in FIG. 5, by causing the magnetic attraction jig M to contact the front surface 11 of the building surface material 10, a magnetic field J generated from the magnetic attraction jig M reaches the mounting surface 41 of the steel stud 40 on the back surface side of the building surface material 10, and an attraction force F attracted toward the magnetic attraction jig M acts on the mounting surface 41.

Here, it is desirable that the magnetic attraction jig M has a magnet specification that generates the attraction force F necessary to sufficiently attract the stud 40 on the back surface of the building surface material 10, according to the thickness of the building surface material.

The mounting surface 41 of the stud 40 and the back surface 12 of the building surface material 10 are attracted to each other by the attraction force F of the magnetic attraction jig M, and the two wide surfaces of the adhesive 80 interposed between the mounting surface 41 and the back surface 12 are pressed by the mounting surface 41 and the back surface 12. By pressing the two wide surfaces of the adhesive 80 in this way, the entire wide surface of the adhesive 80 can be adhered to both the mounting surface 41 and the back surface 12.

In this way, the mounting surface 41 of the stud 40 and the back surface 12 of the building surface material 10 are attracted and adhered to each other, and, therefore, the mounting surface 41 and the back surface 12 are mutually pressure-bonded (or calking pressure-bonding) (main fixing step).

By attracting the stud 40 to the building surface material 10 by the attraction force F of the magnetic attraction jig M, even in the case where the stud 40 is slightly bent, good adherence can be achieved, and there is no problem, for example, that the pressing pressure is distributed when pressing the front surface 11 of the building surface material 10.

Further, even if the adhesive 80 is concealed by the building surface material 10 at the time of mounting, by attracting the stud 40 to the building surface material 10 by the attraction force F of the magnetic attraction jig M, the mounting surface 41 of the stud 40 and the back surface 12 of the building surface material 10 can be pressure-bonded to each other in a state that a predetermined adhesion area is secured.

Further, fasteners such as screws are not applied, and, therefore, the mounting of the building surface material 10 can be carried out in a noiseless atmosphere, and it is possible to eliminate the need of performing a putty process on fastening marks such as screw marks remaining on the front surface 11 of the building surface material 10.

[Mounting Method of a Building Surface Material According to a Second Embodiment]

Figure 6:
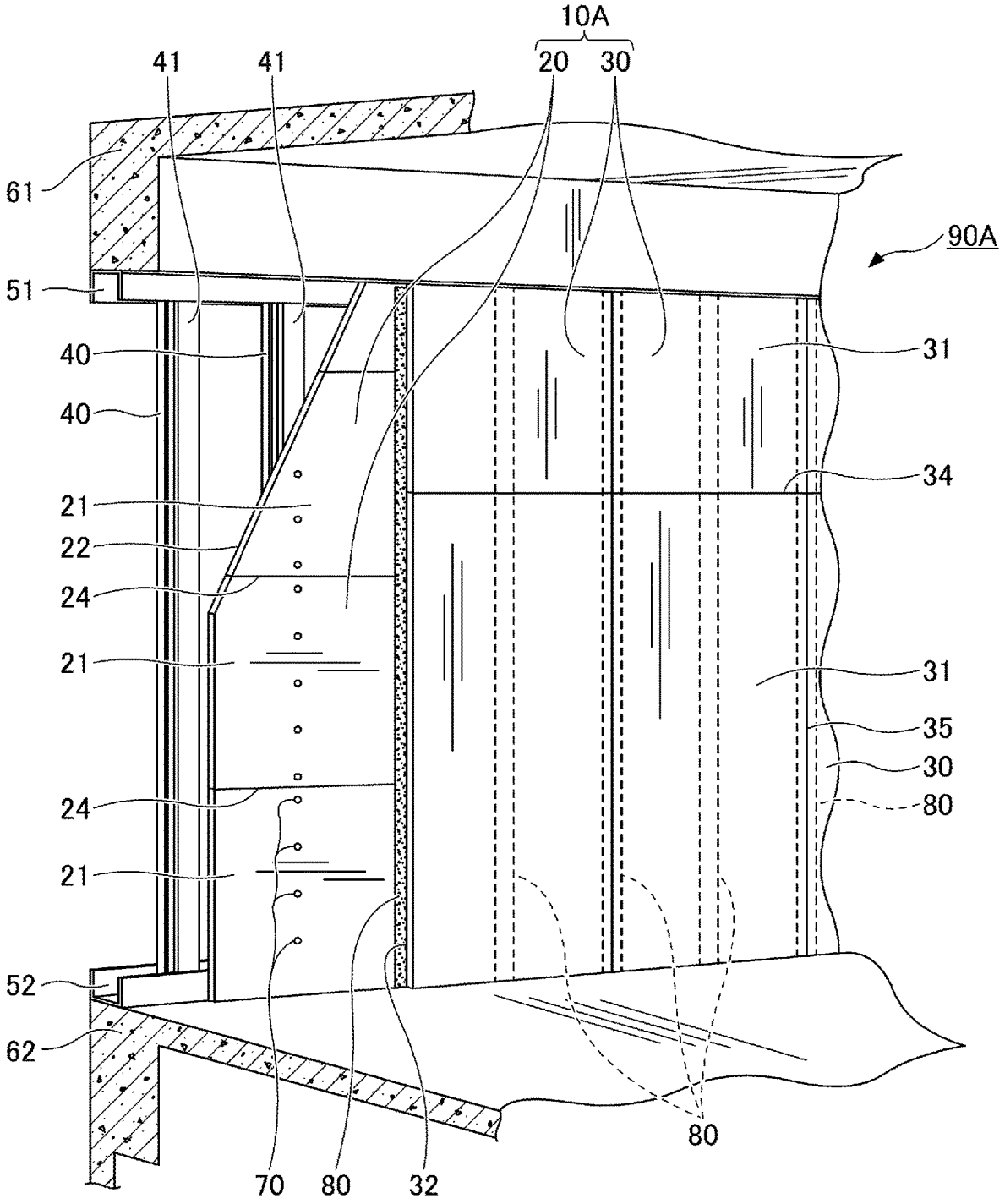
FIG. 6 is a perspective view illustrating an example of a partition wall formed by the mounting method of the building surface material according to the second embodiment, in which a part of the underlining surface material is illustrated to appear fractured.

Next, with reference to FIGS. 6 to 10, an example of the mounting method of the building surface material according to the second embodiment and an example of a partition wall formed by the mounting method will be described. FIG. 6 is a perspective view illustrating an example of a partition wall formed by the mounting method of the building surface material according to the second embodiment, in which a part of the underlining surface material is illustrated to appear fractured. FIGS. 7 to 10 are process diagrams for sequentially explaining the method of mounting a building surface material according to the second embodiment.

A partition wall 90A illustrated in FIG. 6 is different from the partition wall 90 in that the partition wall 90A uses a building surface material 10A having a double upholstered structure including a underlining surface material 20 and a overlining surface material 30.

A back surface 22 of the plurality of underlining surface materials 20 is laterally arranged with respect to the mounting surface 41 of the plurality of studs 40, and is fixed to the mounting surface 41 by screws 70 (an example of fasteners). A plurality of the underlining surface materials 20 that are adjacent to each other at the top, bottom, left, and right are mutually butted to form a lateral butt joint 24 and a longitudinal butt joint (not illustrated).

On a front surface 21 of the underlining surface material 20, at a position corresponding to the mounting surface 41 of the stud 40, an adhesive 80 is adhered along the longitudinal direction of the mounting surface 41, and a back surface 32 of the overlining surface material 30 is mounted to the front surface 21 of the underlining surface material 20 via the adhesive 80.

The overlining surface material 30 is mounted to the front surface 21 of the plurality of the underlining surface material 20 via the adhesive 80 at the position corresponding to the mounting surface 41 of the three studs 40, similar to the building surface material 10 of the partition wall 90. A plurality of the overlining surface materials 30 that are adjacent to each other at the top, bottom, left, and right are mutually butted to form a lateral butt joint 34 and a longitudinal butt joint 35. The lateral butt joint 34 and the longitudinal butt joint 35 may be a transparent joint.

In the partition wall 90A, the time required for mounting the overlining surface material 30 can be shortened and good workability can be obtained by fixing the overlining surface material 30 to the front surface 21 of the underlining surface material 20 via the adhesive 80.

Further, in a partition wall 90A described in detail below, the underlining surface material 20 is fixed to the stud 40 not by the adhesive 80 but by the screw 70, and because the underlining surface material 20 is fixed to the stud 40 by the screw 70 having higher fire resistance than the adhesive 80, in the case of a fire, the building surface material 10A is prevented from falling off the stud 40 as much as possible. In the illustrated example, the underlining surface material 20 is arranged laterally and the overlining surface material 30 is arranged longitudinally, but in other cases, the underlining surface material 20 may be arranged longitudinally and the overlining surface material 30 may be arranged laterally, the underlining surface material 20 and the overlining surface material 30 may both be arranged longitudinally, and the underlining surface material 20 and the overlining surface material 30 may both be arranged laterally.

Next, with reference to FIGS. 7 to 10, a method for mounting the building surface material 10A forming the partition wall 90A illustrated in FIG. 6 to the mounting surface 41 of the stud 40 will be described. In the following, a single stud 40 will be taken as an example to describe the method for sequentially mounting the underlining surface material 20 and the overlining surface material 30 to the mounting surface 41 of the single stud 40. However, in the example illustrated in FIG. 6, the underlining surface material 20 is mounted to the mounting surface 41 of each of the five studs 40 arranged side by side along the lateral direction by the same method, and the overlining surface material 30 is mounted to a position corresponding to the mounting surfaces 41 of each of the three studs 40 arranged side by side along the lateral direction. The underlining surface material 20 and the overlining surface material 30 may both be formed of a gypsum plate or a gypsum board, or one may be formed of a gypsum plate or a gypsum board and the other may be formed of a calcium silicate plate.

Figure 7:
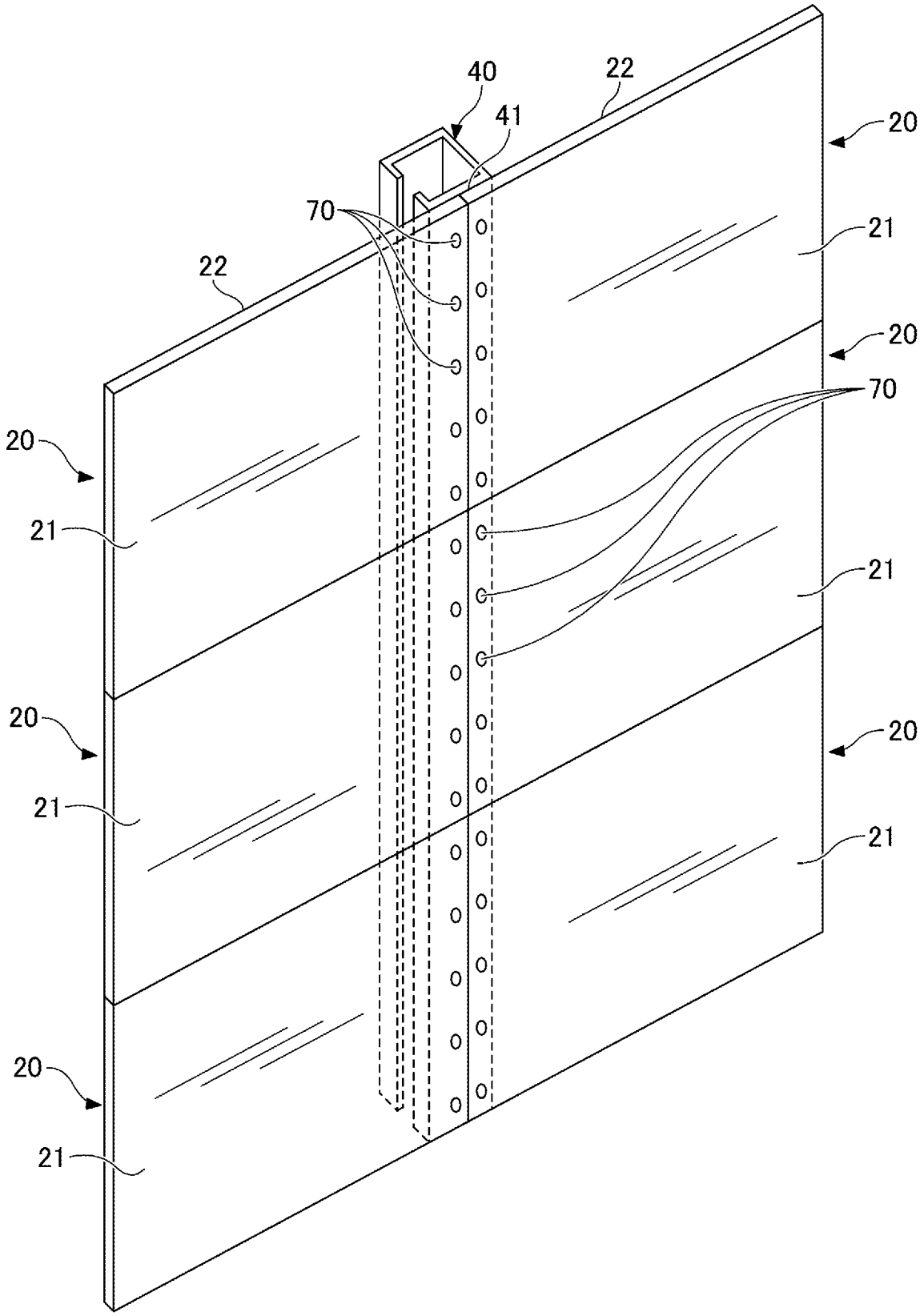
FIG. 7 is a process diagram explaining the mounting method of the building surface material according to a second embodiment.

First, as illustrated in FIG. 7, the back surface 22 of a plurality of the underlining surface materials 20 arranged laterally is positioned with respect to the mounting surface 41 of the stud 40, and the underlining surface materials 20 are fixed by driving in a plurality of the screws 70 (five in the illustrated example) from the front surface 21 of the underlining surface material 20 (first main fixing step).

Figure 8:
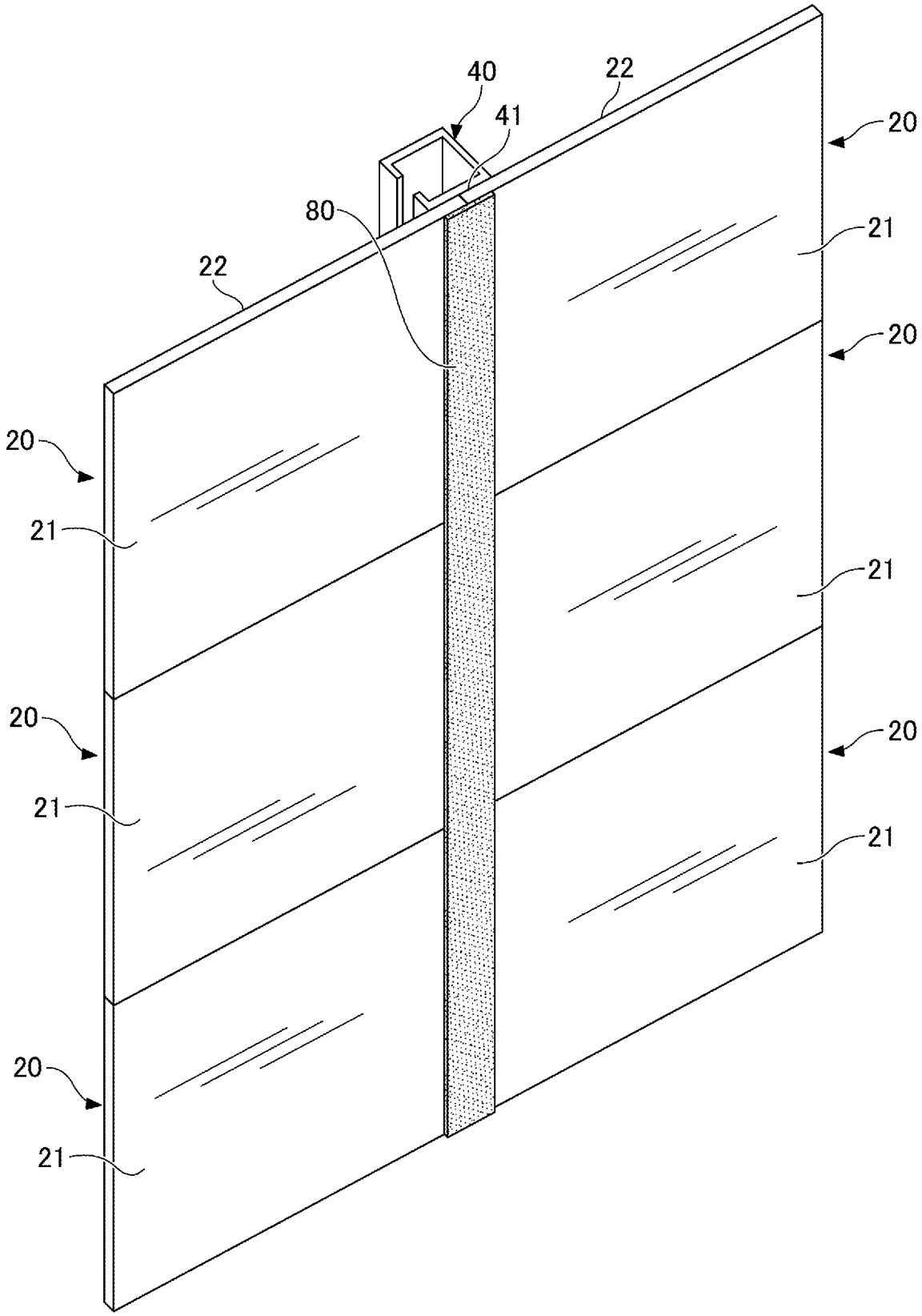
FIG. 8 is a process diagram explaining the mounting method of the building surface material according to the second embodiment following FIG. 7.

Next, as illustrated in FIG. 8, the adhesive 80 is adhered along the longitudinal direction of the mounting surface 41 to a position corresponding to the mounting surface 41 of the stud 40, on the front surface 21 of the underlining surface material 20.

Figure 9:
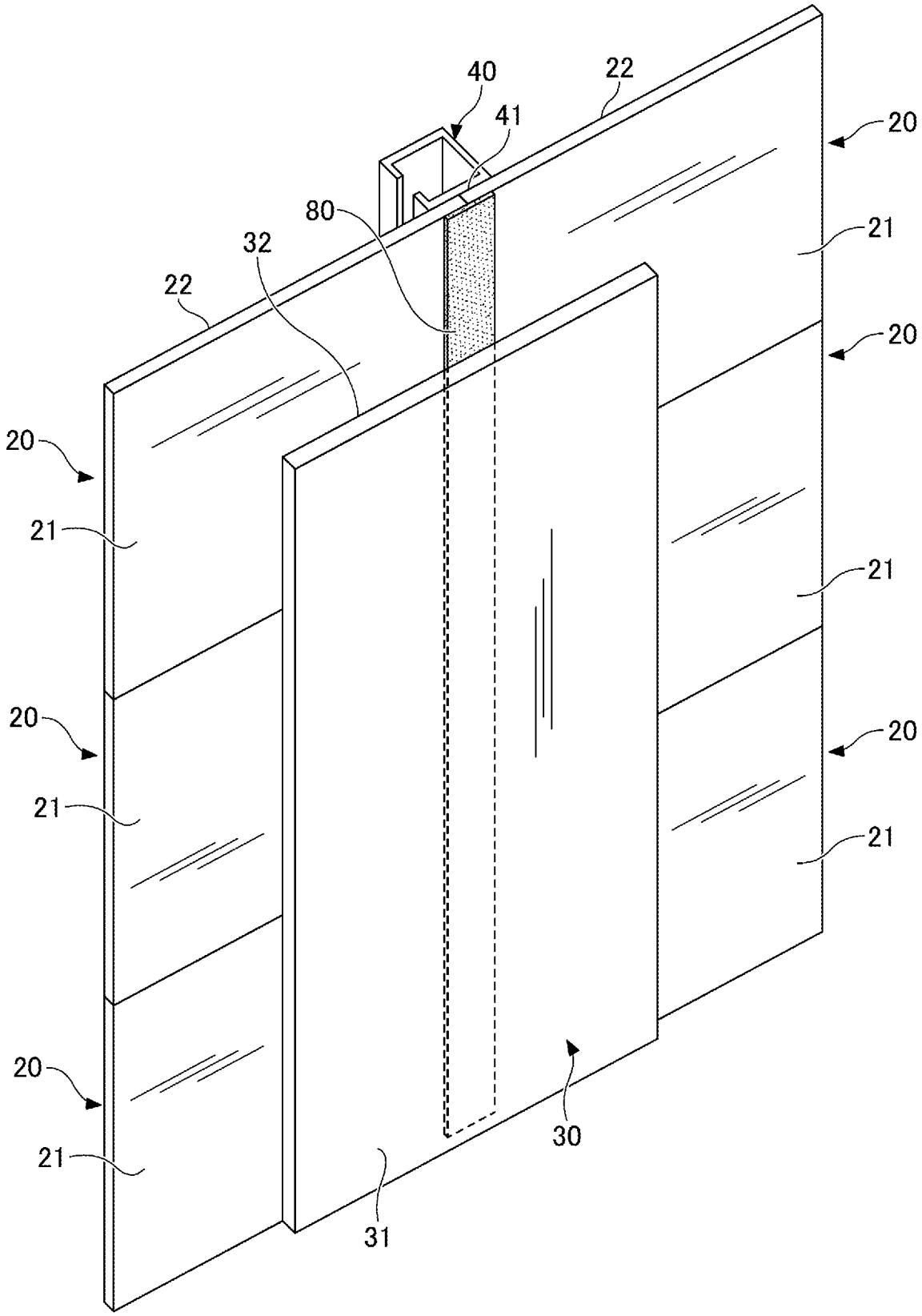
FIG. 9 is a process diagram for explaining a method of mounting a building surface material according to the second embodiment, following FIG. 8.

Next, as illustrated in FIG. 9, the overlining surface material 30 is positioned with respect to the mounting surface 41 of the stud 40, a part of the back surface 32 of the overlining surface material 30 is adhered to the adhesive 80, and the overlining surface material 30 is adhered by being pressed from a front surface 31 to the back surface side (temporary fixing step).

Figure 10:
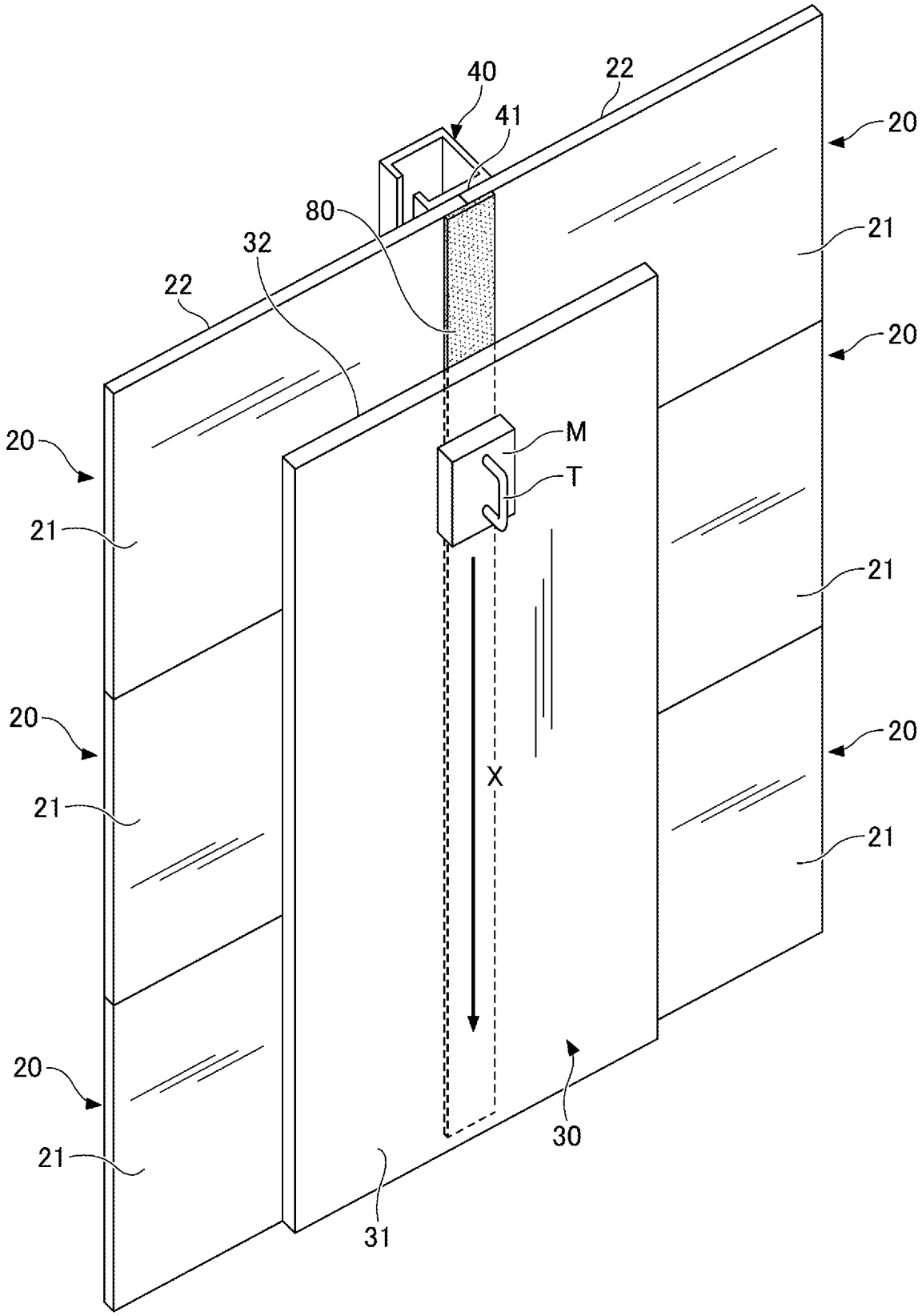
FIG. 10 is a process diagram for explaining a method of mounting a building surface material according to the second embodiment, following FIG. 9.

After the overlining surface material 30 is temporarily fixed to the front surface 21 of the underlining surface material 20, as illustrated in FIG. 10, the magnetic attraction jig M gripped by a worker (not illustrated) is brought into contact with the front surface 31 of the overlining surface material 30, and is moved along the adhesive 80 in the X direction.

By moving the magnetic attraction jig M, the mounting surface 41 of the stud 40 is attracted to the overlining surface material 30 side by the attraction force F of the magnetic attraction jig M, and the pair of wide surfaces of the adhesive 80 interposed between the front surface 21 and the back surface 32 are pressed by the mutually attracted front surface 21 of the underlining surface material 20 and the back surface 32 of the overlining surface material 30. By pressing the pair of wide surfaces of the adhesive 80 by the front surface 21 and the back surface 32 in this way, the entire wide surface of the adhesive 80 is pressure-bonded to both the front surface 21 and the back surface 32 (second main fixing step).

By using the magnetic attraction jig M to attract the stud 40 to the overlining surface material 30 by the attraction force F, good adhesion between the underlining surface material 20 and the overlining surface material 30 can be attained. Further, even if the adhesive 80 is concealed by the overlining surface material 30 at the time of mounting, by using the magnetic attraction jig M to attract the stud 40 to the overlining surface material 30 by the attraction force F, the front surface 21 of the underlining surface material 20 and the back surface 32 of the overlining surface material 30 can be mutually pressure-bonded while securing a predetermined adhesion area.

[Mounting Method of a Building Surface Material According to a Third Embodiment]

Figure 11:
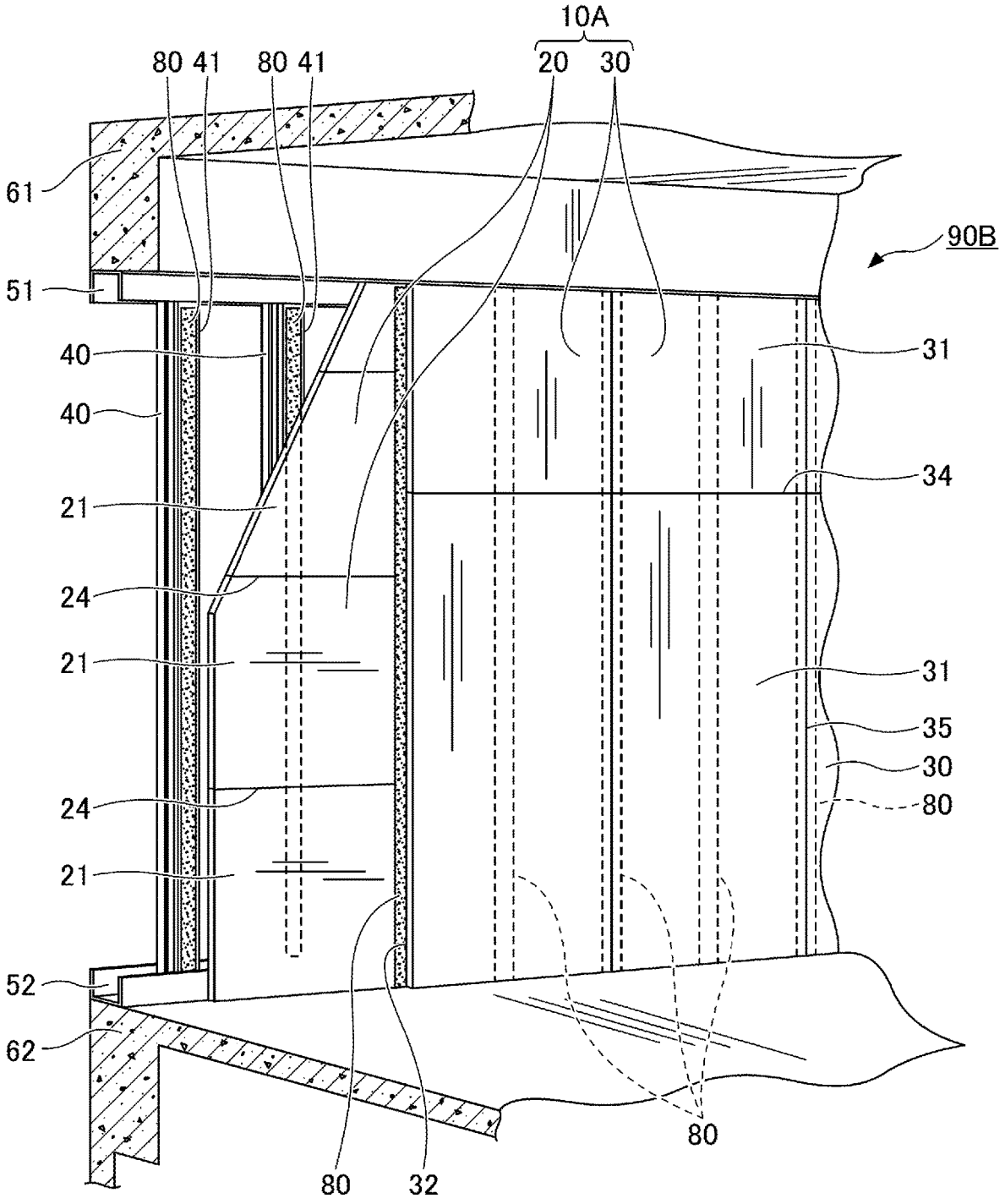
FIG. 11 is a perspective view illustrating an example of a partition wall formed by a method of mounting a building surface material according to a third embodiment, in which a part of the underlining surface material is illustrated to appear fractured.

Next, with reference to FIGS. 11 to 15, an example of the mounting method of a building surface material according to a third embodiment and an example of a partition wall formed by the mounting method will be described. FIG. 11 is a perspective view illustrating an example of a partition wall formed by the mounting method of the building surface material according to the third embodiment, in which a part of the underlining surface material is illustrated to appear fractured. FIGS. 12 to 15 are process diagrams for sequentially explaining the method of mounting a building surface material according to the third embodiment.

The partition wall 90B illustrated in FIG. 11 uses the building surface material 10A having a double upholstered structure including the underlining surface material 20 and the overlining surface material 30, and differs from the partition wall 90A in that the underlining surface material 20 is adhered and fixed to the stud 40.

The back surface 22 of a plurality of underlining surface materials 20 is laterally arranged with respect to the mounting surface 41 of the plurality of studs 40 and fixed to the mounting surface 41 via the adhesive 80. A plurality of the underlining surface materials 20 that are adjacent to each other at the top, bottom, left, and right are mutually butted to form the lateral butt joint 24 and the longitudinal butt joint (not illustrated).

On the front surface 21 of the underlining surface material 20, a separate adhesive 80 is adhered to a position corresponding to the mounting surface 41 of the stud 40 along the longitudinal direction of the mounting surface 41, and the back surface 32 of the overlining surface material 30 is mounted to the front surface 21 of the underlining surface material 20 via the adhesive 80.

The overlining surface material 30 is mounted to the front surface 21 of the plurality of underlining surface materials 20 via the adhesive 80 at a position corresponding to the mounting surface 41 of the three studs 40, similar to the building surface material 10 of the partition wall 90. The plurality of the overlining surface materials 30 that are adjacent to each other at the top, bottom, left, and right are mutually butted to form the lateral butt joint 34 and the longitudinal butt joint 35. The lateral butt joint 34 and the longitudinal butt joint 35 may be a transparent joint.

In the partition wall 90B, the underlining surface material 20 is fixed to the mounting surface 41 of the stud 40 via the adhesive 80 and the overlining surface material 30 is fixed to the front surface 21 of the underlining surface material 20 via the adhesive 80, and, therefore, the time required for mounting both the underlining surface material 20 and the overlining surface material 30 can be shortened, and good workability can be obtained.

Next, with reference to FIGS. 12 to 15, a method for mounting the building surface material 10A forming the partition wall 90B illustrated in FIG. 11 to the mounting surface 41 of the stud 40 will be described. In the following, a single stud 40 will be taken as an example to describe the method for mounting the underlining surface material 20 to the mounting surface 41 of one stud 40 and mounting the overlining surface material 30 to the corresponding position of the mounting surface 41 in the underlining surface material 20 will also be described in the following description.

Figure 12:
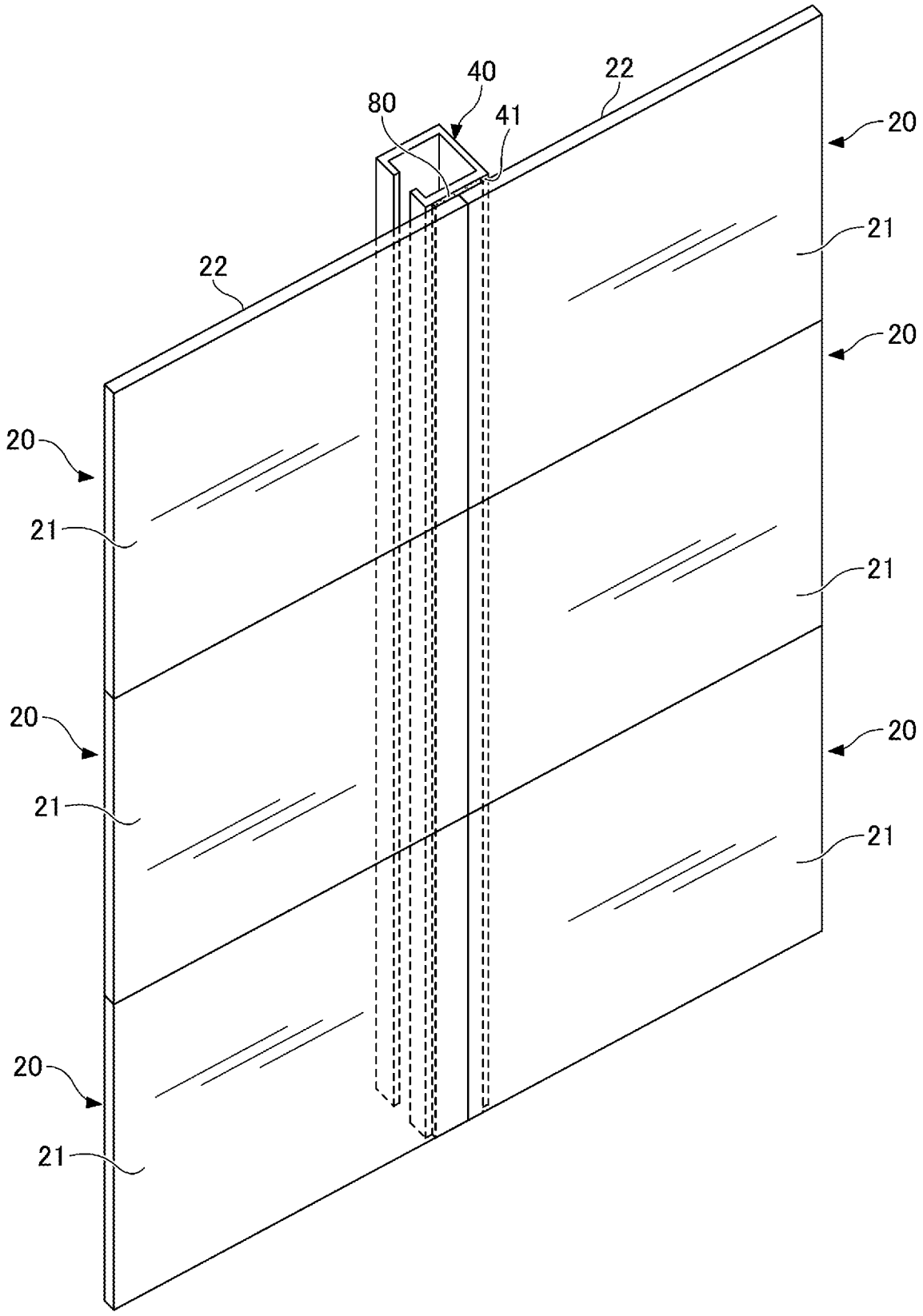
FIG. 12 is a process diagram explaining a method of mounting a building surface material according to the third embodiment.

First, as illustrated in FIG. 12, the adhesive 80 is adhered to the mounting surface 41 of the stud 40 along the longitudinal direction, the underlining surface material 20 is positioned with respect to the mounting surface 41 of the stud 40, a part of the back surface 22 of the underlining surface material 20 is adhered to the adhesive 80, and the underlining surface material 20 is adhered by being pressed from the front surface 21 to the back surface side (first temporary fixing step).

Figure 13:
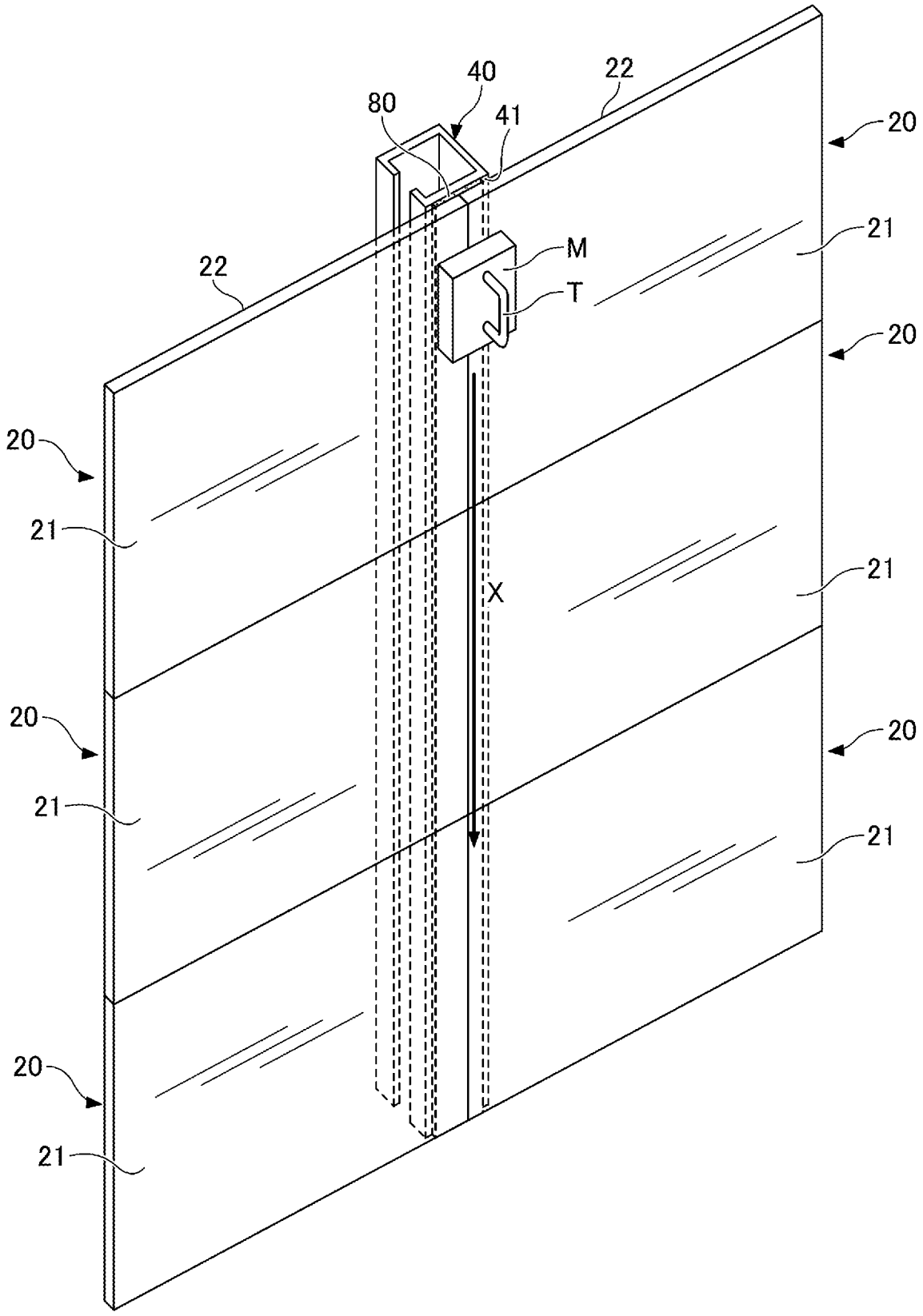
FIG. 13 is a process diagram explaining a method of mounting a building surface material according to the third embodiment following FIG. 12.

After the underlining surface material 20 is temporarily fixed to the mounting surface 41 of the stud 40, as illustrated in FIG. 13, the magnetic attraction jig M gripped by a worker (not illustrated) is brought into contact with the front surface 21 of the underlining surface material 20 and moved in the X direction along the adhesive 80.

By moving the magnetic attraction jig M, the mounting surface 41 of the stud 40 is attracted to the underlining surface material 20 side by the attraction force F of the magnetic attraction jig M, and a pair of wide surfaces of the adhesive 80 interposed between the mounting surface 41 and back surface 22 are pressed by the mutually attracted mounting surface 41 of the stud 40 and the back surface 22 of the underlining surface material 20. As described above, the pair of wide surfaces of the adhesive 80 are pressed by the mounting surface 41 and the back surface 22, so that the entire wide surface of the adhesive 80 is pressure-bonded to both the mounting surface 41 and the back surface 22 (first main fixing step).

Figure 14:
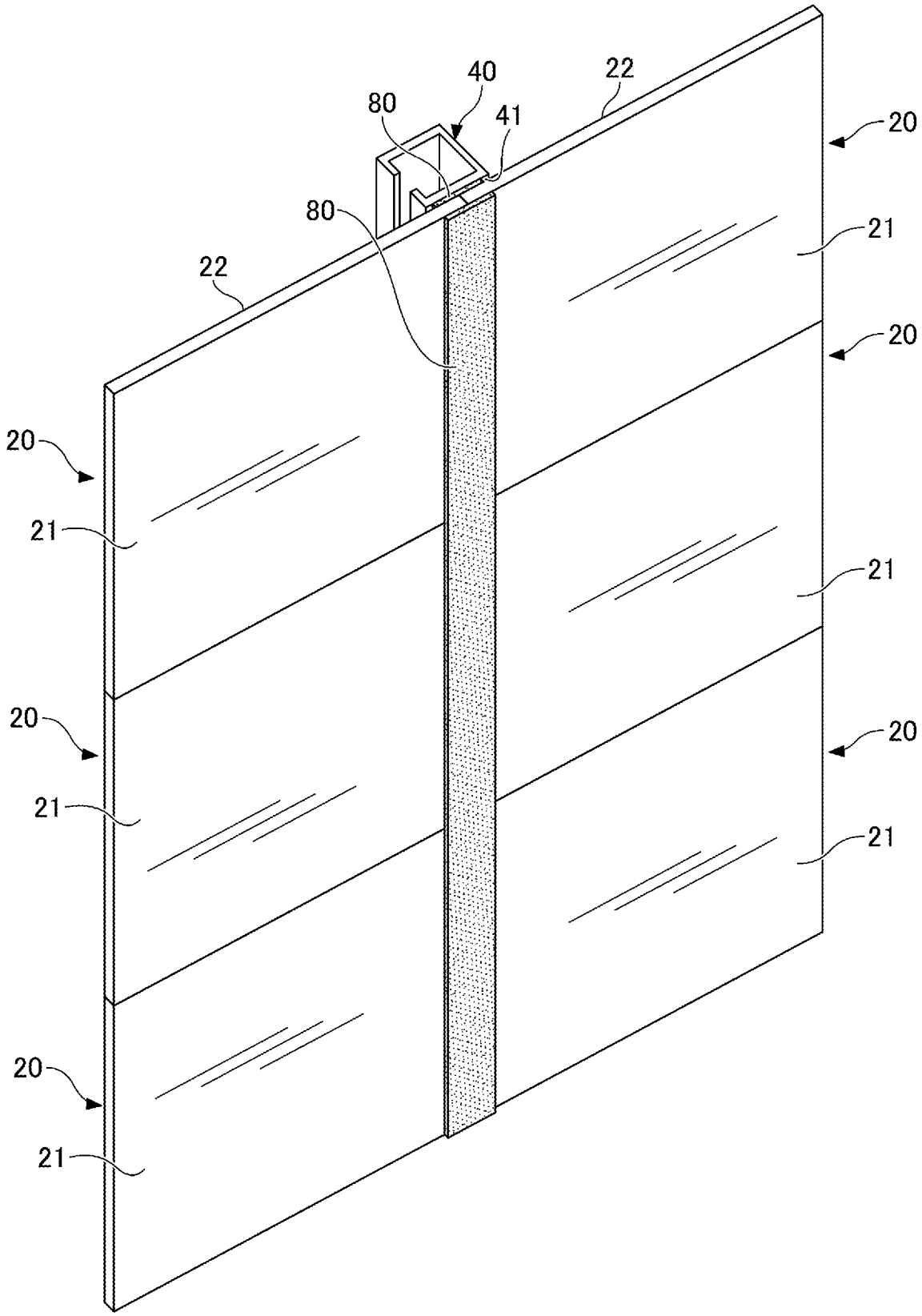
FIG. 14 is a process diagram explaining a method of mounting a building surface material according to the third embodiment following FIG. 13.

Next, as illustrated in FIG. 14, the adhesive 80 is adhered along the longitudinal direction of the mounting surface 41 to a position corresponding to the mounting surface 41 of the stud 40, on the front surface 21 of the underlining surface material 20.

Figure 15:
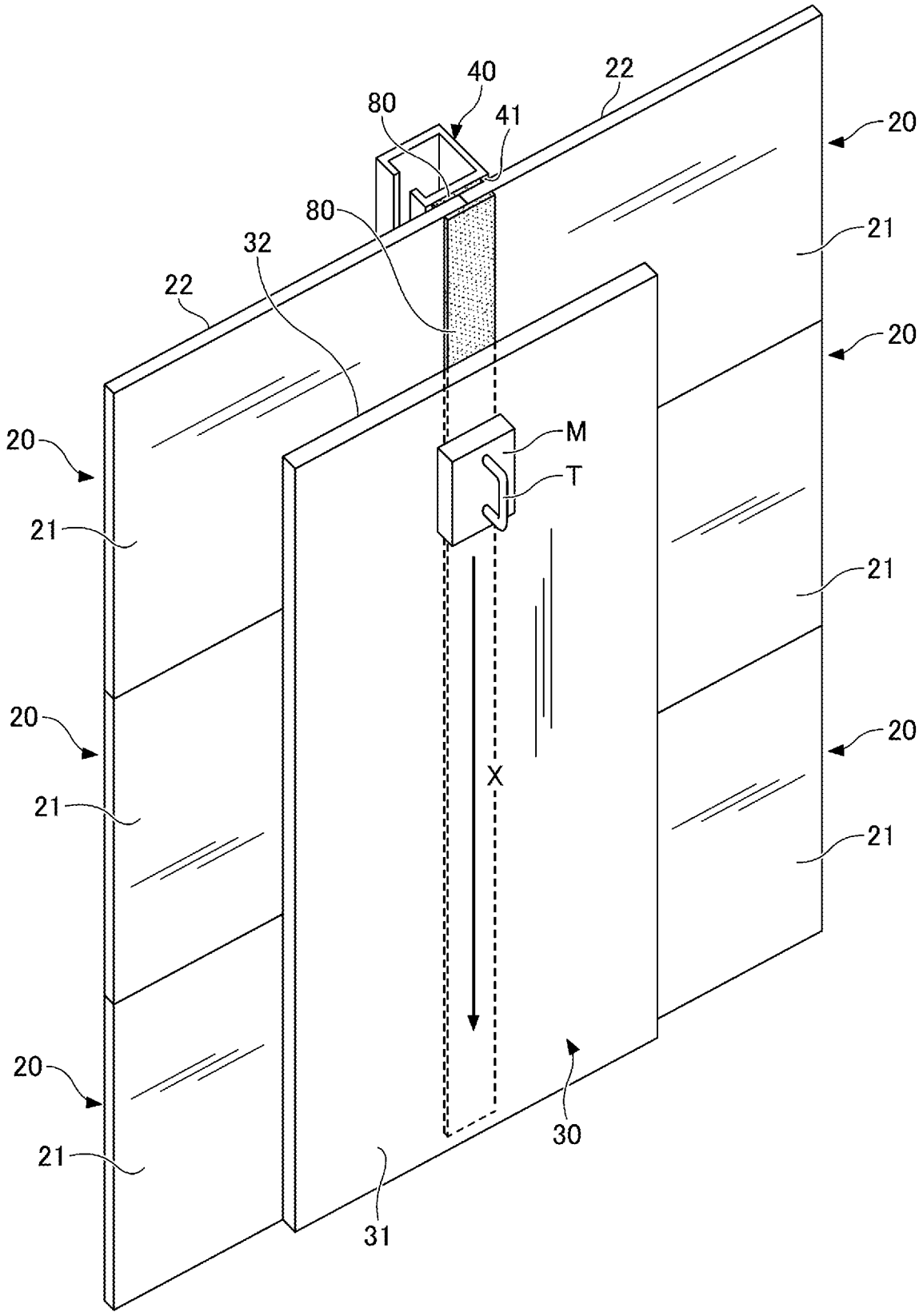
FIG. 15 is a process diagram explaining a method of mounting a building surface material according to the third embodiment following FIG. 14.

Next, as illustrated in FIG. 15, the overlining surface material 30 is positioned with respect to the mounting surface 41 of the stud 40, a part of the back surface 32 of the overlining surface material 30 is adhered to the adhesive 80, and the overlining surface material 30 is adhered by being pressed from the front surface 31 to the back surface side (second temporary fixing step).

After the overlining surface material 30 is temporarily fixed to the front surface 21 of the underlining surface material 20, as illustrated in FIG. 15, the magnetic attraction jig M gripped by a worker (not illustrated) is brought into contact with the front surface 31 of the overlining surface material 30, and moved in the X direction along the adhesive 80.

By moving the magnetic attraction jig M, the mounting surface 41 of the stud 40 is attracted to the overlining surface material 30 side by the attraction force F of the magnetic attraction jig M, and a pair of wide surfaces of the adhesive 80 interposed between the front surface 21 and the overlining surface material 30 are pressed by the mutually attracted front surface 21 of the underlining surface material 20 and the back surface 32 of the overlining surface material 30. By pressing the pair of wide surfaces of the adhesive 80 by the front surface 21 and the back surface 32 in this way, the entire wide surface of the adhesive 80 is pressure-bonded to both the front surface 21 and the back surface 32 (second main fixing step).

As described above, by using the magnetic attraction jig M, the stud 40 is attracted to the underlining surface material 20 by the attraction force F, and the underlining surface material 20 is further attracted to the overlining surface material 30, thereby achieving good adhesion between the stud 40 and the underlining surface material 20, and between the underlining surface material 20 and the overlining surface material 30. Further, even if the adhesive 80 is concealed by the underlining surface material 20 and the overlining surface material 30 at the time of mounting, by using the magnetic attraction jig M to attract the stud 40 to the underlining surface material 20 and the overlining surface material 30 by the attraction force F, the mounting surface 41 of the stud 40 and the back surface 22 of the underlining surface material 20, and the front surface 21 of the underlining surface material 20 and the back surface 32 of the overlining surface material 30, can be pressure-bonded to each other while securing a predetermined adhesion area.

[Modification Example of Mounting Method of a Building Surface Material According to the Third Embodiment]

Figure 16:
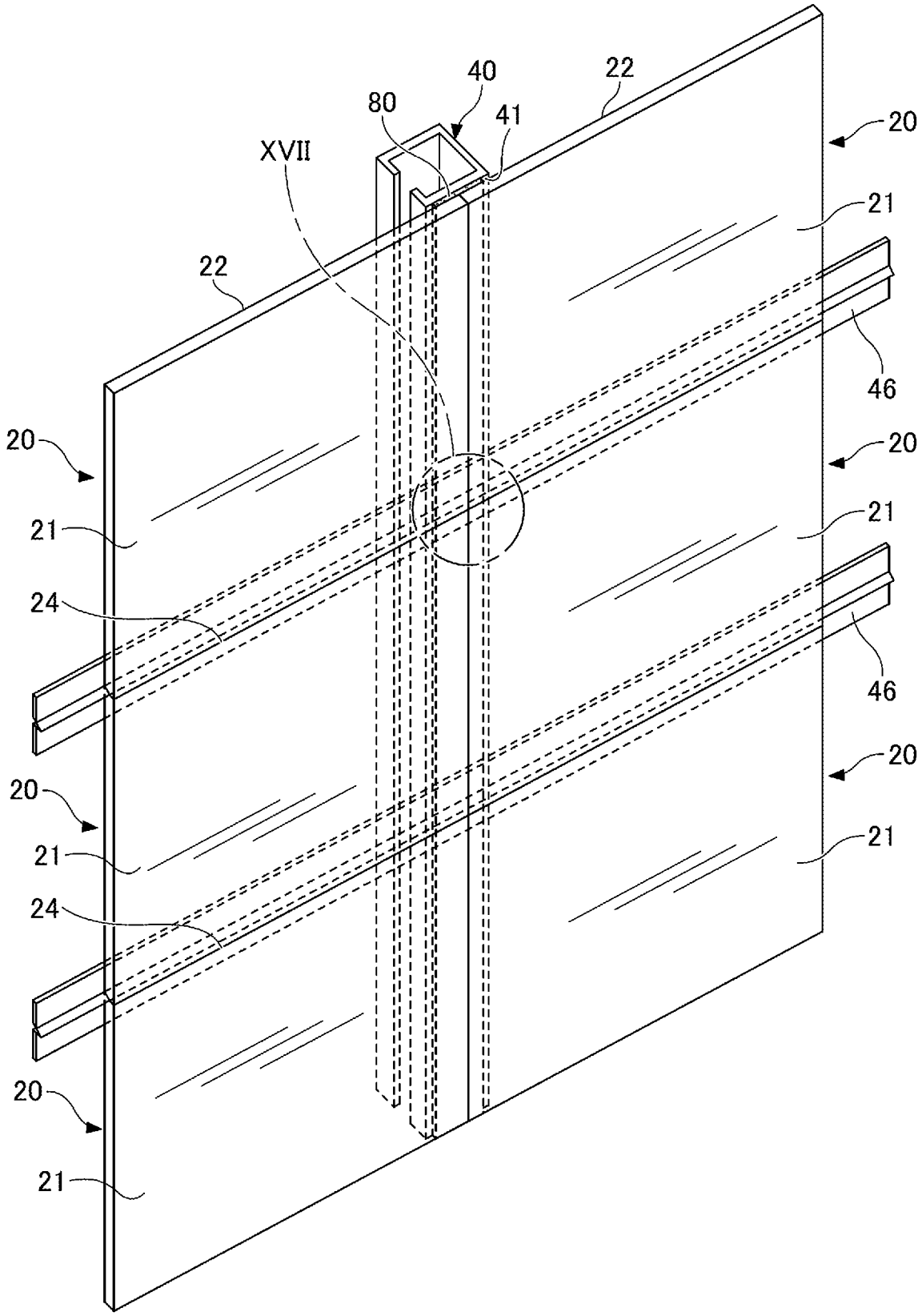
FIG. 16 is a process diagram explaining a method of mounting a building surface material according to a modification example of the third embodiment.
Figure 17:
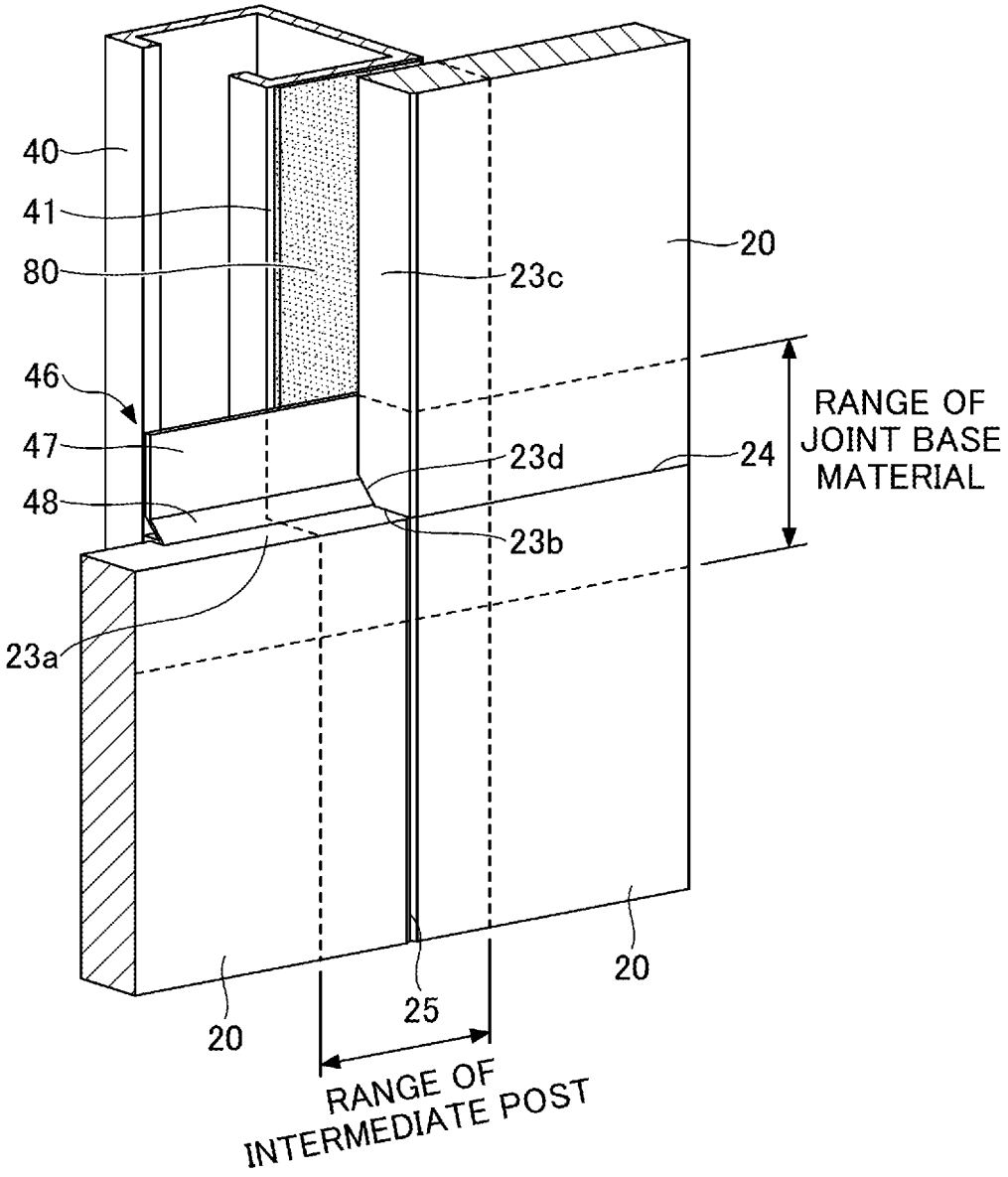
FIG. 17 is an enlarged view of part XVII of FIG. 16 in which a part of the joint base material is made visible.
Figure 18:
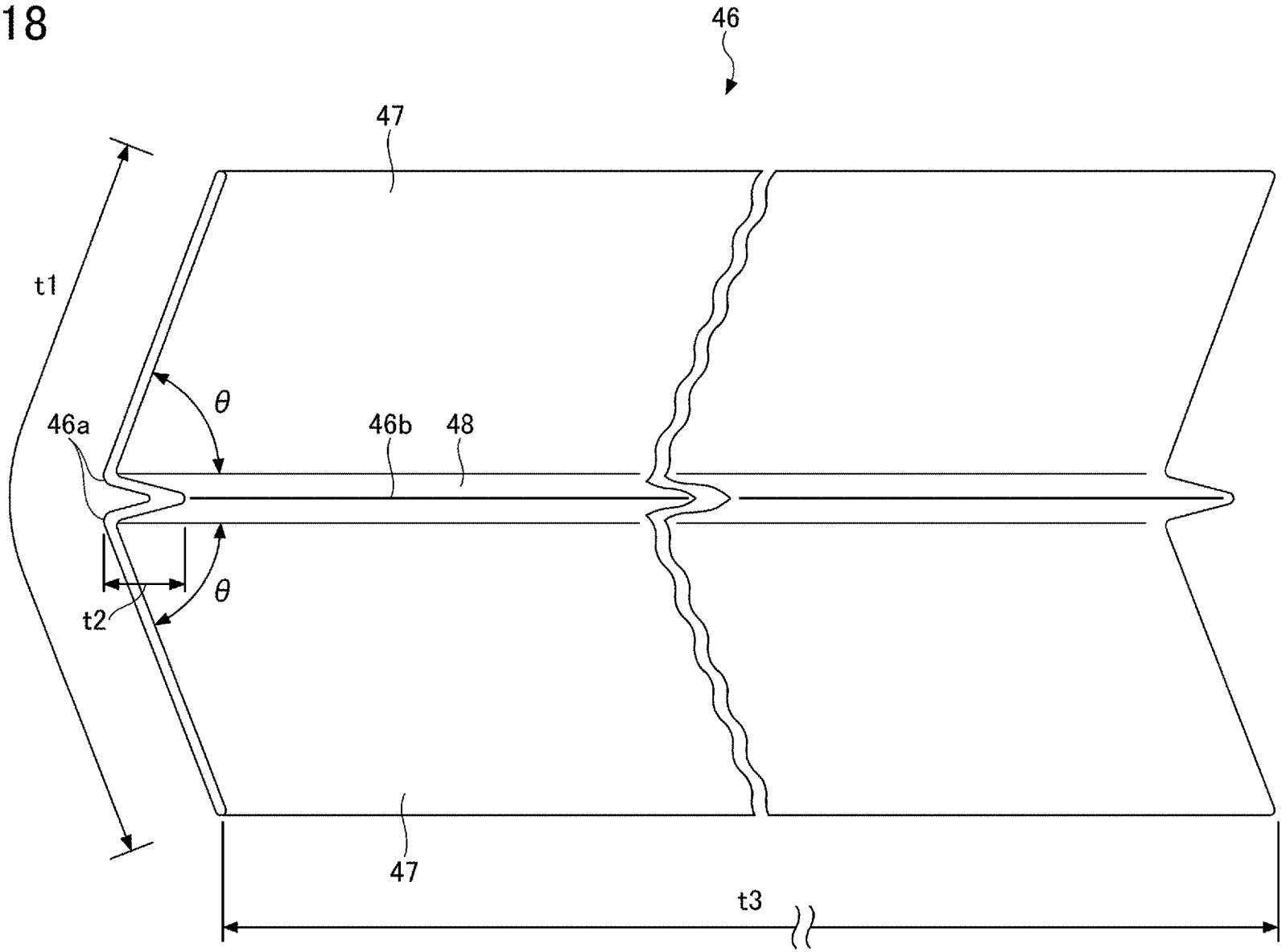
FIG. 18 is a perspective view of an example of the joint base material.

Next, a modification example of the method for mounting the building surface material according to the third embodiment will be described with reference to FIGS. 16 to 18. FIG. 16 is a process diagram explaining the method for mounting the building surface material according to the modification example of the third embodiment, and FIG. 17 is an enlarged view of a part XVII of FIG. 16, in which a part of the joint base material is made visible. FIG. 18 is a perspective view of an example of the joint base material.

As illustrated in FIG. 16, the modified example illustrated in the figure differs from the example of the mounting method of the building base material according to the third embodiment described with reference to FIGS. 12 to 15 in that a joint base material 46 is arranged on the back surface side of a lateral butt joint 24 formed by the upper and lower underlining surface materials 20.

The joint base material 46 has a flame-shielding performance and is a member for preventing hot air at the time of a fire disaster from leaking out to the inside of the partition wall through the lateral butt joint 24. Here, the "flame-shielding performance" refers to a performance for blocking hot air and flame leakage, and includes a material having an inherent fire-resistant performance, a material having a fire-resistant performance after being cured by heat, and a material capable of exerting a flame-shielding performance as a result of remaining as a mass of ashes even after the material itself burns by heat.

As illustrated in FIGS. 16 and 17, after the adhesive 80 is adhered to the mounting surface 41 of the stud 40 along the longitudinal direction, the lower underlining surface material 20 is positioned with respect to the mounting surface 41 of the stud 40, a part of the back surface 22 of the lower underlining surface material 20 is adhered to the adhesive 80, and the lower underlining surface material 20 is adhered by pressing the lower underlining surface material 20 from the front surface 21 to the back surface side. At this time, the upper region of the lower underlining surface material 20 is not pressed to the back surface side because a part of a joint base material 46 is inserted into the back surface side. Here, a longitudinal butt joint 25 is formed between the left and right underlining surface materials 20 adhered to the stud 40 via the adhesive 80.

Next, a portion of the back surface of a back surface piece 47 of the lower joint base material 46 is adhered to the adhesive 80 by inserting the back surface piece 47 of the joint base material 46 into the back surface of the lower underlining surface material 20, placing an overhanging piece 48 of the joint base material 46 on an upper end surface 23*a* of the lower underlining surface material 20, and pressing the upper region of the lower underlining surface material 20 to the back surface side.

Referring now to FIG. 18, an exemplary configuration of the joint base material 46 will be described. The joint base material 46 is formed by bending one plate material (e.g., a metal plate). In the joint base material 46 of the illustrated example, the overhanging piece 48 overhangs from two back surface pieces 47 via two first bending parts 46*a*, and the overhanging piece 48 has a U-shape having a second bending part 46*b*.

Further, the joint base material 46 has a predetermined angle θ that is less than 90 degrees, between the back surface piece 47 and the overhanging piece 48. Here, the predetermined angle θ of less than 90 degrees is approximately about 60 degrees to 88 degrees.

In the joint base material 46, the total width t1 (width of transverse plane) of the two back surface pieces 47 is set to be 40 mm or more. Further, the overhanging piece 48 is provided at the center position of the two back surface pieces 47, and the overhanging length of the overhanging piece 48 is set to be in the range of 5 mm to 20 mm. Further, the length t3 in the longitudinal direction of the joint base material 46 can be set to be in the range of approximately 1815 mm over 6 spans when, for example, the spacing between the studs 40 is approximately 303 mm.

As described above, the total width is 40 mm or more, and the total length is approximately 1815 mm, so that the joint base material 46 has a high aspect ratio, and, therefore, the joint base material 46 may easily bend during conveyance or construction work, and if the joint base material 46 is made of metal, plastic deformation may occur. However, the joint base material 46 has an overhanging piece 48 in the center of the width over the entire length, and, therefore, rigidity against bending is applied by the overhanging piece 48, so that it is possible to reduce or prevent bending, plastic deformation, etc., during conveyance or construction work.

The back surface piece 47 and the overhanging piece 48 have a predetermined angle θ of less than 90 degrees, and, therefore, for example, as illustrated in FIG. 17, when the joint base material 46 is arranged such that the overhanging piece 48 is inserted between the lower end surface 23*b* (small) and the upper end surface 23*a* (small) of the upper and lower underlining surface materials 20, the end of the back surface piece 47 can be closely attached to the back surface of the underlining surface material 20 without a gap.

After a part of the back surface of the lower back surface piece 47 of the joint base material 46 is adhered to the adhesive 80 by pressing the upper region of the lower underlining surface material 20 to the back surface side, the upper underlining surface material 20 is arranged on the lower underlining surface material 20, and a part of the back surface of the upper back surface piece 47 of the joint base material 46 is also adhered to the adhesive 80 by pressing the upper underlining surface material 20 to the back surface side, and both the upper and lower back surface pieces 47 are adhered to the adhesive 80.

Here, the underlining surface material 20 has a chamfer portion 23*d* at a corner portion on the back surface side of the lower end surface 23*b*. The length of the underlining surface material 20 of the chamfer portion 23*d* in the thickness direction is set in a range of, for example, 7 mm to 23 mm.

Accordingly, when the joint base material 46 is arranged on the back surface of the upper and lower underlining surface materials 20, the overhanging piece 48, whose overhanging length t2 is set to be in the range of 5 mm to 20 mm and less than the length in the thickness direction of the chamfer portion 23*d*, can be housed in the chamfer portion 23*d*.

When the back surface of the joint base material 46 is pressed against the stud 40, the upper and lower underlining surface materials 20 are fixed to the stud 40, thereby ensuring to prevent, by the joint base material 46, a gap from being formed (blocked) at the lateral butt joint 24. Therefore, hot air is effectively prevented from leaking into the partition wall through the lateral butt joint 24.

The above is the first temporary fixing step in the modified example of the third embodiment, and then the method already described with reference to FIGS. 13 to 15 is similarly performed.

The mounting method of the building surface material according to the modified example of the third embodiment can also achieve good adhesion between the stud 40 and the underlining surface material 20, and between the underlining surface material 20 and the overlining surface material 30. Further, by using the magnetic attraction jig M to attract the stud 40 to the underlining surface material 20 and the overlining surface material 30 with the attraction force F, the mounting surface 41 of the stud 40 and the back surface 22 of the underlining surface material 20, and the front surface 21 of the underlining surface material 20 and the back surface 32 of the overlining surface material 30, can be mutually pressure-bonded while securing a predetermined adhesion area. Further, by arranging the joint base material 46 on the back surface of the lateral butt joint 24, it is possible to construct a partition wall excellent in flame shielding performance.

Note that other embodiments, such as those in which other elements are combined with the above configurations, may be used, and the present disclosure is not limited to the configurations illustrated here. The configurations of the present disclosure may be changed without departing from the purpose of the present disclosure, and the configurations can be appropriately determined according to the application form.

For example, in the illustrated example, the partition walls 90, 90A, and 90B are formed of the building surface material 10 having a single-ply structure or the building surface material 10A having a double-ply structure, but if the overall thickness of the building surface material is, for example, up to approximately 50 mm, a building surface material having a triple-ply structure or more may be used.

Further, the base material need not be a stud made of steel, and may be a base material made of a material that cannot be magnetically attracted. The "material that cannot be magnetically attracted" may include wood, mortar, concrete, reinforced concrete, resin, etc.

The method further includes a base material forming step in which a base material (a steel base material) to be magnetically attracted as a whole is formed with a base material and a steel plate or the like by directly or indirectly fixing a magnetically attracted material such as a steel plate to a mounting surface of the base material. After the base material forming step, each step of the mounting method of the building surface material according to the first to third embodiments is performed.

The present international application is based upon and claims priority to Japanese Patent Application No. 2021-205428 filed on Dec. 17, 2021, the entire contents of which are incorporated herein by reference.

EXPLANATION OF REFERENCE NUMERALS

10, 10A: building surface material
11: front surface
12: back surface
14: lateral butt joint
15: longitudinal butt joint
20: underlining surface material
21: front surface
22: back surface
23*a*: upper end surface
23*b*: lower end surface
23*d*: chamfer portion
24: lateral butt joint
25: longitudinal butt joint
30: overlining surface material
31: front surface
32: back surface
34: lateral butt joint
35: longitudinal butt joint
40: base material (stud)
41, 42: mounting surface
44: upper end
45: lower end
46: joint base material
51: upper runner
52: lower runner
61, 62: floor structure
70: fastener (screw)
80: adhesive
90, 90A, 90B: partition wall
M: magnetic attraction jig
T: handle
J: magnetic field
F: attraction force

The invention claimed is:

1. A mounting method of a building surface material for mounting the building surface material to a base material made of steel, the mounting method comprising:

temporarily fixing a part of a back surface of the building surface material to an adhesive adhered to a mounting surface of the base material; and bringing a non-rotating magnetic attraction jig in contact with a front surface on an opposite side of the back surface of the building surface material, and moving the non-rotating magnetic attraction jig along the adhesive to attract the base material by an attraction force of the non-rotating magnetic attraction jig such that the adhesive is pulled toward the building surface material and pressed by the base material and pressure-bond the building surface material and the base material to each other.

2. The mounting method of the building surface material according to claim 1, wherein the base material made of steel is a stud made of steel.

3. The mounting method of the building surface material according to claim 1, further comprising:

forming the base material made of steel by fixing a steel plate directly or indirectly to a base material made of a material that is not magnetically attracted.

4. The mounting method of the building surface material according to claim 3, wherein the material that is not magnetically attracted is any one of wood, mortar, concrete, reinforced concrete, or resin.

5. The mounting method of the building surface material according to claim 1, wherein the building surface material is a gypsum plate or a gypsum board.

6. A mounting method of a building surface material for mounting an underlining surface material and an overlining surface material which are the building surface material to a base material made of steel, the mounting method comprising:

fixing the underlining surface material to a mounting surface of the base material with a fastener;

temporarily fixing a part of a back surface the overlining surface material to an adhesive adhered to a front surface of the underlining surface material on an opposite side of a back surface of the underlining surface material facing the mounting surface; and bringing a non-rotating magnetic attraction jig in contact with a front surface of the overlining surface material on an opposite side of the back surface of the overlining surface material, and moving the non-rotating magnetic attraction jig along the adhesive to attract the base material by an attraction force of the non-rotating magnetic attraction jig such that the adhesive is pulled toward the building surface material and pressed by the base material and pressure-bond the overlining surface material and the base material to each other.

7. The mounting method of the building surface material according to claim 6, wherein one of the underlining surface material or the overlining surface material is a gypsum plate or a gypsum board, and another one of the underlining surface material or the overlining surface material is a calcium silicate plate.

8. A mounting method of a building surface material for mounting an underlining surface material and an overlining surface material which are the building surface material to a base material made of steel, the mounting method comprising:

temporarily fixing a part of a back surface of the underlining surface material to an adhesive adhered to a mounting surface of the base material;

bringing a non-rotating magnetic attraction jig in contact with a front surface of the underlining surface material on an opposite side of the back surface of the underlining surface material, and moving the non-rotating magnetic attraction jig along the adhesive to attract the base material by an attraction force of the non-rotating magnetic attraction jig such that the adhesive is pulled toward the building surface material and pressed by the base material and pressure-bond the underlining surface material and the base material to each other;

temporarily fixing a part of a back surface of the overlining surface material to an adhesive adhered to the front surface of the underlining surface material; and bringing the non-rotating magnetic attraction jig in contact with a front surface of the overlining surface material on an opposite side of the back surface of the overlining surface material, and moving the non-rotating magnetic attraction jig along the adhesive to attract the base material by an attraction force of the non-rotating magnetic attraction jig such that the adhesive is pulled toward the building surface material and pressed by the base material and pressure-bond the overlining surface material and the base material to each other.

* * * * *